US005906535A

United States Patent [19]

Tonooka et al.

[11] Patent Number: 5,906,535

[45] Date of Patent: May 25, 1999

[54] BALL POLISHING METHOD AND APPARATUS, AND ANNULAR GROOVE FORMING METHOD

[75] Inventors: Katsuhisa Tonooka; Chuichi Sato; Hiroyuki Nojima; Yuichi Sumita; Shoji Jibu, all of Kanagawa, Japan

[73] Assignee: NSK Ltd., Tokyo, Japan

[21] Appl. No.: 08/863,202

[22] Filed: May 27, 1997

[30] Foreign Application Priority Data

May 27, 1996 [JP] Japan ..... 8-152905
Mar. 24, 1997 [JP] Japan ..... 9-087220

[51] Int. Cl.[6] ..... B24B 1/00

[52] U.S. Cl. ..... 451/50; 451/24; 451/79; 384/99; 384/12

[58] Field of Search ..... 457/50, 24, 79; 384/111, 118, 121, 99, 517, 563, 8, 49, 12

[56] References Cited

U.S. PATENT DOCUMENTS 4,099,802 7/1978 Heinemann et al. ..... 384/12
4,763,448 8/1988 Yoshioka ..... 451/24
5,010,794 4/1991 Klager ..... 384/12
5,520,573 5/1996 Sumita et al. ..... 451/50

FOREIGN PATENT DOCUMENTS 4118333 12/1991 Germany ..... 384/12
1105704 7/1984 Russian Federation ..... 384/12
1723385 3/1992 Russian Federation ..... 384/12

*Primary Examiner*—Robert A. Rose
*Assistant Examiner*—George Nguyen
*Attorney, Agent, or Firm*—Sughrue, Mion, Zinn Macpeak & Seas, PLLC

[57] ABSTRACT

A ball polishing method includes the steps of rotating one of two plates through use of a rotating mechanism while balls are sandwiched between the plates, pressing one of the two plates against the other plate via a guide slide mechanism for guiding one of the two plates to the other plate by means of a pressing mechanism, and polishing the balls while the pressing force is regulated through use of a pressing force control mechanism. The method is further provided with rotary support means for supporting the rotating mechanism and guide support means for supporting the guide slide mechanism, and at least one of them utilizes hydrostatics. By virtue of this method, a machining pressure can be controlled with a high degree of accuracy, and the accuracy of polishing of balls can be improved.

18 Claims, 19 Drawing Sheets

BALL POLISHING METHOD AND APPARATUS, AND ANNULAR GROOVE FORMING METHOD

BACKGROUND OF THE INVENTION

The present invention relates to a method and an apparatus for polishing balls for use in a ball bearing or the like, as well as to a method of forming an annular groove for guiding a ball when it is abraded.

As illustrated in FIG. 1, in this type of conventional ball polishing apparatus, a plurality of annular grooves (ball grooves) 4 having a size substantially equal to the diametrical size of a ball 3 to be polished are concentrically formed in a rotary plate 1 which rotates and in a fixed plate 2 which is stationary and opposite to the rotary plate 1. A rotary conveyor 5 which rotates conveys and introduces the balls 3 to be polished to the annular grooves 4 where they are polished so as to comply with predetermined standards.

In actually polishing the balls 3, some ball polishing apparatuses contain tens of thousands of balls 3 which are stored in the conveyor 5 at one time, and they are repeatedly polished by through feed. These "tens of thousands of balls 3" stored in the conveyor 5 at one time will hereinafter be referred to as one lot. After the balls 3 of one lot have undergone all the processing steps, the next lot will be processed.

As illustrated in FIGS. 2A and 2B, the polishing process required for one lot usually includes several stages (e.g. three stages; i.e., a roughing stage, a semi-finishing stage, and a finishing stage). Machining pressures are controlled so as to ensure the accuracy of a machining speed and a diametrical size corresponding to each stage. FIG. 2A illustrates the relationship between machining pressures and the corresponding machining stages; and FIG. 2B illustrates the relationship between the amount of variations in the diametrical size of the ball and the respective machining stages.

As illustrated in FIG. 2A, the largest machining pressure is preset for the roughing stage, and a middle degree of machining pressure is preset for the semi-finishing stage. Then, the least machining pressure is preset for the finishing stage. In this way, the machining pressure is changed according to the machining stage, thereby increasing the amount of polishing of the ball 3 in the roughing stage and bringing the ball 3 close to a desired ball in terms of the accuracy of the surface and finished size (the diametrical size of the ball) in the finishing stage.

FIG. 2B illustrates the amounts of scheduled polishing allowance for the ball 3 in the respective machining stages, indicating the difference between the purposes of machining.

FIG. 3 is a longitudinal cross section illustrating the configuration of the conventional ball polishing apparatus. In the drawing, supports 7*a*, 7*b* are provided on a bed 6. A rotary plate 1 is supported by the support 7*a* (on the left-hand side of the drawing) so as to be rotatable and movable in the longitudinal direction of the bed 6. In other words, the support 7*a* doubles as a guide member. The rotary plate 1 is fixed to a flange 9 which is integrally formed at one end of a rotary shaft 8. The rotary shaft 8 is rotatively inserted into the center hole formed in a piston rod 10 which is fitted into the center hole of the support 7*a* in a a slidable manner. The rotary shaft 8 is supported at both ends by the piston rod 10 via rolling bearings 11*a* and 11*b*, such as ball bearings or taper-roller bearings, so as to be rotatable and to be slidable together with the piston rod 10. A pulley 12 is fitted to the other end of the rotary shaft 8 via a spline so as to be slidable. The pulley 12 is connected to the drive shaft of a motor by way of an endless belt (not shown). The rotary plate 1 is rotated together with the rotary shaft 8 by means of a drive force of the motor.

Two oil chambers 13*a* and 13*b* are formed between the internal circumferential surface of the center hole of the support 7*a* and the external circumferential surface of the piston rod 10, and liquid-operated (hydraulic) ports 14*a* and 14*b* are bored in the support 7*a* so as to communicate with the respective oil chambers 13*a* and 13*b*. These hydraulic ports 14*a* and 14*b* are connected to a hydraulic circuit (not shown). The rotary plate 1 slides over the bed 6 in its longitudinal direction in the drawing together with the piston rod 10 by alternate influx or efflux of a working (hydraulic) fluid into or out of the respective hydraulic chambers 13*a* and 13*b*. The rotary plate 1 is pressed against the surface of the fixed plate 2 mounted on the support 7*b* by feeding the hydraulic fluid into the hydraulic chamber 13*a*, and by discharging the hydraulic fluid out of the hydraulic chamber 13*b*. The pressing force is regulated by a pressure regulation mechanism provided in the hydraulic circuit. In FIG. 3, a bellows cover 15 prevents exposure of a portion of the piston rod 10 in the vicinity of one end of the support 7*a*.

With the balls 3 to be polished being sandwiches between the rotary plate 1 and the fixed plate 2 (that is between the annular grooves 4), the rotary plate 1 is rotated while it is pressed against the fixed plate 2. As a result, the balls 3 repeatedly pass along the annular grooves 4, whereby the balls 3 are polished so as to achieve desired size and quality. This polishing process is usually carried out while machining pressures (the machining pressures of the rotary disk 1) and the rotational speed of the rotary disk 1, or the like, are regulated. Further, the polishing process is comprised of two or three steps; i.e., roughing and finishing steps or of three steps; i.e., roughing, semi-finishing, and finishing steps. In this cased it is desirable to control the machining load imposed on the ball 3 (a load imposed on the rotary plate 1) in the final finishing process to ensure as small a force as possible with as high accuracy as possible.

In a case where annular grooves are formed in both plates of the conventional ball polishing apparatus, annular grooves are previously formed in the fixed plate by a lathe or the like, and this fixed plate is attached to a fixed plate mount on the main body of the polishing apparatus.

Subsequently, a so-called "plate conditioning" is carried out; namely, balls to be polished are introduced into the space between a plane rotary plate without annular grooves which has a grindstone fitted and the fixed plate having the annular grooves formed therein, and then the polishing of the balls is repeated, so that annular grooves are formed in the rotary plate. The "plate conditioning operation" is continued until the annular grooves of the rotary disk are formed to a predetermined depth, and uniform contact is ensured between the balls and the annular grooves formed in both plates.

The previously described conventional ball polishing apparatus presents the following problems:

A sliding guide mechanism is of high frictional resistance, and a rolling guide is usually subjected to an increase in frictional force due to a pre-load or resistance in it's sealing section. The frictional force or resistance is not negligible as compared to a pressure required to polish the ball 3. For this reason, as illustrated in FIG. 4, hysteresis develops in the regulated machining pressure during the course of polishing of the balls 3 when the machining pressure is regulated according to the machining process. Further, since the frictional force changes even during stable machining operations, it is difficult to control the machining pressure with a high degree of accuracy.

In the conventional ball polishing apparatus illustrated in FIG. 3 which uses the sliding guide, if the balls 3 are polished under the polishing pressures in the respective three machining steps; namely, the roughing step, the semi-finishing step, and the finishing step, as illustrated in FIGS. 2A and 2B, actual machining pressures in the respective machining steps change to become higher or lower due to the previously-described hysteresis with reference to preset values, thereby rendering the practical machining pressures unstable.

In the foregoing process of polishing the balls 3 while they are sandwiches between the annular grooves 4 concentrically formed in both plates 1 and 2, it is necessary to concentrically rotate the annular grooves 4 formed in the fixed plate 2 and the annular grooves formed in the rotary plate 1 with a high degree of accuracy. However, if there is a relative rotational error in the rotary plate 1 or a relative eccentricity, a relative positional displacement arises in the annular grooves 4 that are formed in the rotary plate 1 and in the fixed plate 2 so as to be opposite to each other as illustrated in FIG. 5, thereby adversely affecting the accuracy of the machining of the balls 3. More specifically, variations arise in the diameter and sphericity of the balls 3 in one lot.

The cited conventional ball polishing apparatus employs a combination of the sliding guide and rolling movement or a combination of the rolling guide and the rolling movement, and therefore the previous problems arise at one time.

In some cases, conventional desired specifications may present no problems even if the balls are used as a ball bearing for use in; e.g., a conventional hard disk drive. However, these balls have become insufficient to cope with a recent tendency toward hard disk drives (HDD) with increased capacity. The reason for this is an increase in the degree of rigorousness of the requirements for asynchronous oscillating components (NRRO) caused by the ball bearing.

In terms of improvements in the accuracy of the balls 3 to be machined, there is a limit to the control of the machining pressure of the conventional ball polishing apparatus. The profiles of the annular grooves 4 which are formed in the rotary plate 1 and the fixed plate 2 so as to be opposite to each other must be correct, and it is necessary to minimize the relative positional errors (see FIG. 5) in the annular grooves 4 while the balls 3 introduced between the plates 1 and 2 travel to the exit from the entrance.

If a relative positional error arises in the annular grooves 4 that are opposite to each other, an uncontrollable load acts on the balls 3. Exertion of such a load on the balls 3 in the final step of the polishing process intended to increase the accuracy of the balls 3 results in the deterioration of the accuracy of quality of the balls 3. Both annular grooves 4 are formed by repeatedly polishing the balls 3 spuriously between a fixed plate in which annular grooves are concentrically formed previously by turning and a rotary plate without annular grooves. Accordingly, in principle, the relative positional error in the annular grooves 4 formed in the plates 1 and 2 is corrected.

However, an original rotational error exists in a support bearing of the rotary plate 1. In general, the rotational error in the support bearing is about 1 to 10 micrometers for a rolling bearing and is about 0.1 to 0.2 micrometers for a hydrostatic bearing. Therefore, there is no real chance of complete agreement in relative position between the annular grooves 4. So long as attention is given solely to the fixed plate, the balls 3 which pass through the annular grooves 4 are repeatedly brought into the states illustrated in FIGS. 6A and 6B. In this case, the profile of the annular grooves 4 formed in either the rotary plate 1 or the fixed plate 2 will become damaged inappropriately, or improvements in the sphericity of the balls 3 will be prevented.

In the conventional ball polishing apparatus, a machining pressure application means (a hydraulic cylinder) used in the roughing process is the same as a machining pressure application means used in the finishing process. The machining pressure application means manufactured in accordance with a machining pressure used in the roughing process produces large frictional resistance when sliding under a low machining pressure in the finishing process. Therefore, it is difficult to control the machining pressure with a high degree of accuracy.

In contrast, in the light of alignment between the two plates 1 and 2, variations in the machining pressure during the machining operation will result in changes in the deformation of the support of the rotary plate 1 or the fixed plate 2 even under a low load during the final finishing process. Eventually, there arise variations in the alignment between the plates 1 and 2, which makes it impossible to ensure the quality of the balls with a high degree of accuracy.

Further, according to a conventional pressurizing method in which a machining pressure is applied by means of a hydraulic cylinder or a spring, the thus-regulated machining pressure is held substantially constant regardless of the dimensional differences among the balls 3 within a lot which are being machined between the plates 1 and 2. Therefore, it is difficult to correct the amount of variation in the size of the balls 3 among groups of balls 3 having fine dimensional variations in one lot of the balls 3 to be machined between the plates 1 and 2.

Moreover, in the method of forming annular grooves in both plates of the conventional ball polishing apparatus, attention is paid to prevention of an eccentricity between the center of pitch circle of each annular grooves previously formed in a fixed plate and the rotary center of a rotary shaft. However, there usually arises an eccentricity of about 10 to 20 micrometers. For this reason, it is usually necessary to perform the previously-described "plate conditioning operation" for two to three months until the eccentricity is corrected. If the fixed plate is made of a casting, and the rotary plate is made of a grindstone, the amount of abrasion to the rotary plate incurred during a ball polishing step is small, in turn extending the time required for the "plate conditioning operation" in order to correct the eccentricity.

SUMMARY OF THE INVENTION

The present invention has been conceived to solve the foregoing drawbacks in the background art, and the primary object of the present invention is to provide a ball polishing method and a ball polishing apparatus, both of which are capable of improvements in the accuracy of machining size of a ball by controlling a machining pressure with a high degree of accuracy.

A second object of the present invention is to provide a ball polishing method and a ball polishing apparatus, both of which are capable of reducing errors in the rotation of a rotary plate and of producing highly accurate balls.

A third object of the present invention is to provide a ball polishing method and a ball polishing apparatus, both of which are capable of polishing a ball without changing the aligned relationship between a rotary plate and a fixed plate while a force acting on ball-supporting portions of both plates is held constant, of controlling the force acting on the balls sandwiches between the plates with a high degree of accuracy, of improving the capability of correction of diametrical sizes of the ball, and of producing highly accurate balls.

A fourth object of the present invention is to provide a method of forming annular grooves in a fixed plate of a ball polishing apparatus which is capable of reducing an eccentricity between annular grooves previously formed in a fixed plate and the center of rotation of a rotary plate to as small a value as possible, and of reducing the time required for plate conditioning carried out in a ball polishing process.

Additional objects, advantages and novel features of the invention will be &et forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the first object, and in accordance with the purposes of the present invention, there is provided a ball polishing method comprising the steps of:

rotating one of two plates through use of a rotating mechanism while balls are sandwiches between the two plates; pressing one of the two plates against the other plate of the two plates via a guide slide mechanism for guiding one of the two plates to the other of the two plate by means of a pressing mechanism;

polishing the balls while the pressing force is regulated through use of a pressing force control mechanism; and hydrostatically supporting at least one of the rotating mechanism and the guide slide mechanism.

Preferably, the hydrostatically supporting step comprises the steps of: rotatably supporting the rotating mechanism with a rolling bearing; and hydrostatically supporting the guide slide mechanism with a hydrostatic guide.

Advantageously, the hydrostatically supporting step comprises the steps of: hydrostatically and rotatably supporting the rotating mechanism with a hydrostatic bearing; and supporting the guide slide mechanism with a rolling guide. the rotary support means is formed into a hydrostatic bearing, and the guide support means is formed into a rolling guide.

Further advantageously, the hydrostatically supporting step comprises the steps of; hydrostatically and rotatably supporting the rotating mechanism with a hydrostatic bearing; and hydrostatically supporting the guide slide mechanism with a hydrostatic guide.

To achieve the second object, in accordance with another aspect of the present invention, the above-mentioned ball polishing method further comprising the steps of:

suppressing positional variations between annular grooves formed in one of the two plates so as to face the other of the two plate and annular grooves formed in the other of the two plate so as to be confronted with the annular grooves of the one of the two plate.

To achieve the third object, in accordance with still another aspect of the present invention, the above-mentioned ball polishing method further comprising the steps of:

finely controlling a force that is exerted on the opposite faces of the two plates by the pressing force of the pressing mechanism.

To achieve the first object, and in accordance with the purposes of the present invention, there is provided a ball polishing apparatus comprising:

a rotating mechanism for rotating one of two plates while balls are sandwiches between the two plates, a guide slide mechanism for guiding the one of the two plates to the other of the two plates;

a pressing mechanism for pressing one of the two plates against the other of the two plates via the guide slide mechanism so as to polish the balls while the pressing force is regulated through use of a pressing force control mechanism; and rotary support means for supporting the rotating mechanism; and guide support means for supporting the guide slide mechanism, in which at least one of the rotary support means and the guide support means utilizes hydrostatics.

Preferably, the rotary support means is formed into an rolling bearing, and the guide support means is formed into a hydrostatic guide.

Advantageously, the rotary support means is formed into a hydrostatic bearing, and the guide support means is formed into a rolling guide.

Further advantageously, the rotary support means is formed into an hydrostatic bearing, and the guide support means is formed into a hydrostatic guide.

To achieve the second object, in accordance with another aspect of the present invention, the ball polishing apparatus is preferably provided with a rigidity control mechanism for controlling the shaft support rigidity of the rotary support means in order to suppress positional variations between annular grooves formed in one of the plates so as to face the other plate and annular grooves formed in the other plate so as to face the annular grooves of that plate through use of a rigidity control mechanism.

To achieve the third object, in accordance with still another aspect of the present invention, the ball polishing apparatus is preferably provided with fine adjustment means for finely controlling the force that is exerted on the opposite faces of the two plates by the pressing force of the pressing mechanism.

To achieve the fourth object, in accordance with yet another aspect of the present invention, there is provided a method of forming annular grooves in a fixed plate of a ball polishing apparatus which includes a rotary plate rotatively attached to a rotary plate mount of the main body of the ball polishing apparatus and a fixed plate attached to a fixed plate mount of the main body of the ball polishing apparatus so as to be nonrotatable and opposite to the rotary plate, wherein balls are polished by rotatively moving them along annular grooves while the balls are sandwiches in a pressed manner between the annular grooves formed in the rotary and fixed plates, the method comprising the steps of:

fitting a cutting tool to the rotary plate so as to be rotatable together with the rotary plate; and rotating the rotary plate so as to form the annular grooves in the fixed plate through use of the cutting tool.

To achieve the fourth object, in accordance with a further aspect of the present invention, there is provided a method of forming annular grooves in a fixed plate of a ball polishing apparatus which includes a rotary plate rotatively attached to a rotary plate mount of the main body of the ball polishing apparatus and a fixed plate attached to a fixed plate mount of the main body of the ball polishing apparatus so as to be nonrotatable and opposite to the rotary plate, wherein balls are polished by rotatively moving them along annular grooves while the balls are sandwiches in a pressed manner between the annular grooves formed in the rotary and fixed plates, the method comprising the steps of:

attaching a cutting tool to the rotary plate mount having a rotary base plate which coaxially and integrally rotates together with the rotary plate; and forming the annular grooves in the fixed plate by the cutting tool while the rotary base plate is being rotated.

Still other objects of the present invention will become readily apparent to those skilled in the art from the following descriptions wherein there are shown and described preferred embodiments of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the descriptions serve to explain the principles of the invention, in the drawings.

DETAILED DESCRIPTION OF THE PREFERRED EMBODIMENTS

Reference will now be made in detail to the present preferred embodiments of the invention, examples of which are illustrated in the accompanying drawings.

First Embodiment

With reference to FIGS. 7 through 12, a first embodiment of the present invention will be described. The present embodiment is directed to a ball polishing apparatus in which a guide slide mechanism S of a rotary plate 1 is formed into a hydrostatic slide.

Figure 7:
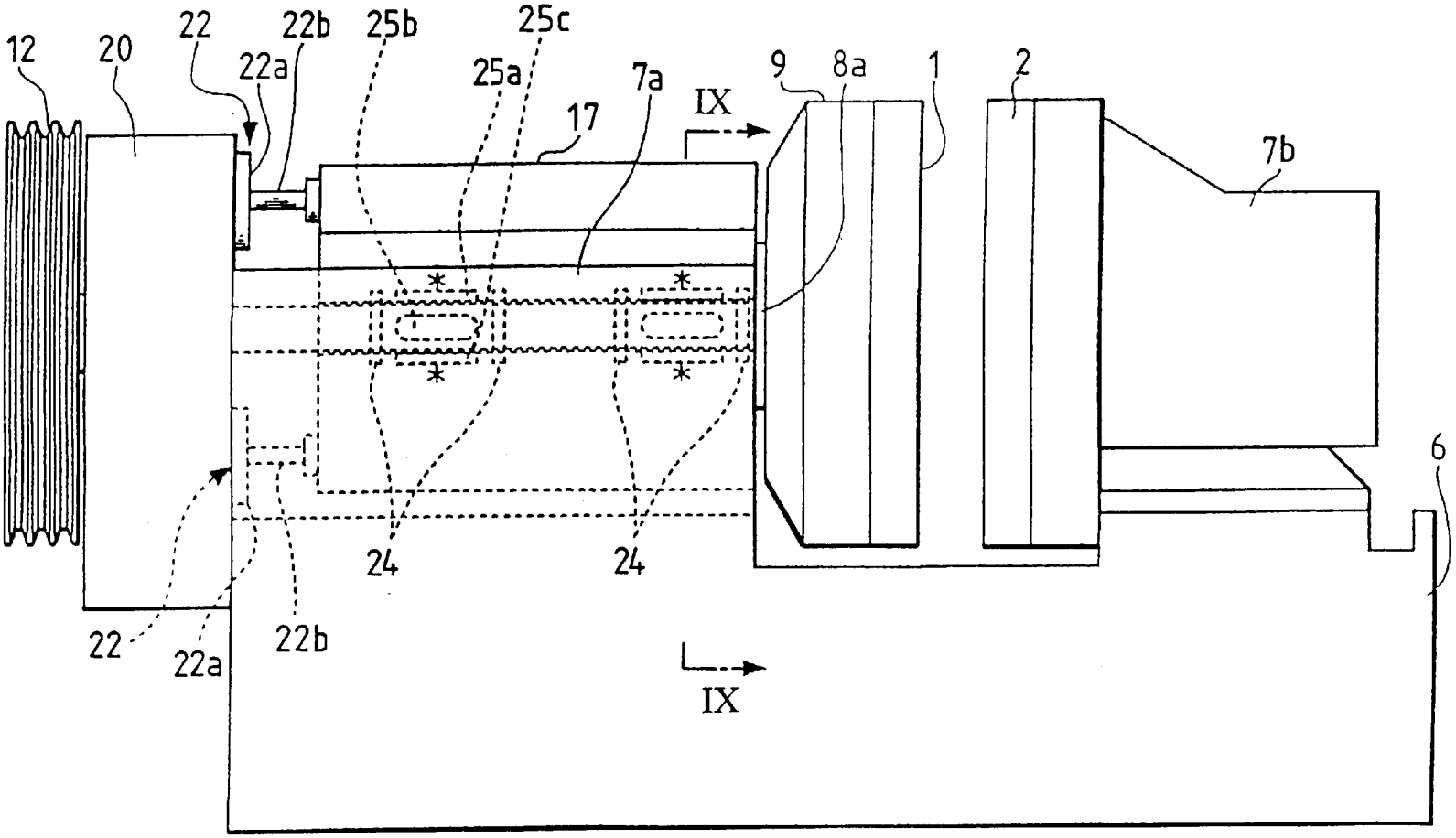
FIG. 7 is a longitudinal schematic side view illustrating the structure of a ball polishing apparatus according to a first embodiment of the present invention.
Figure 8:
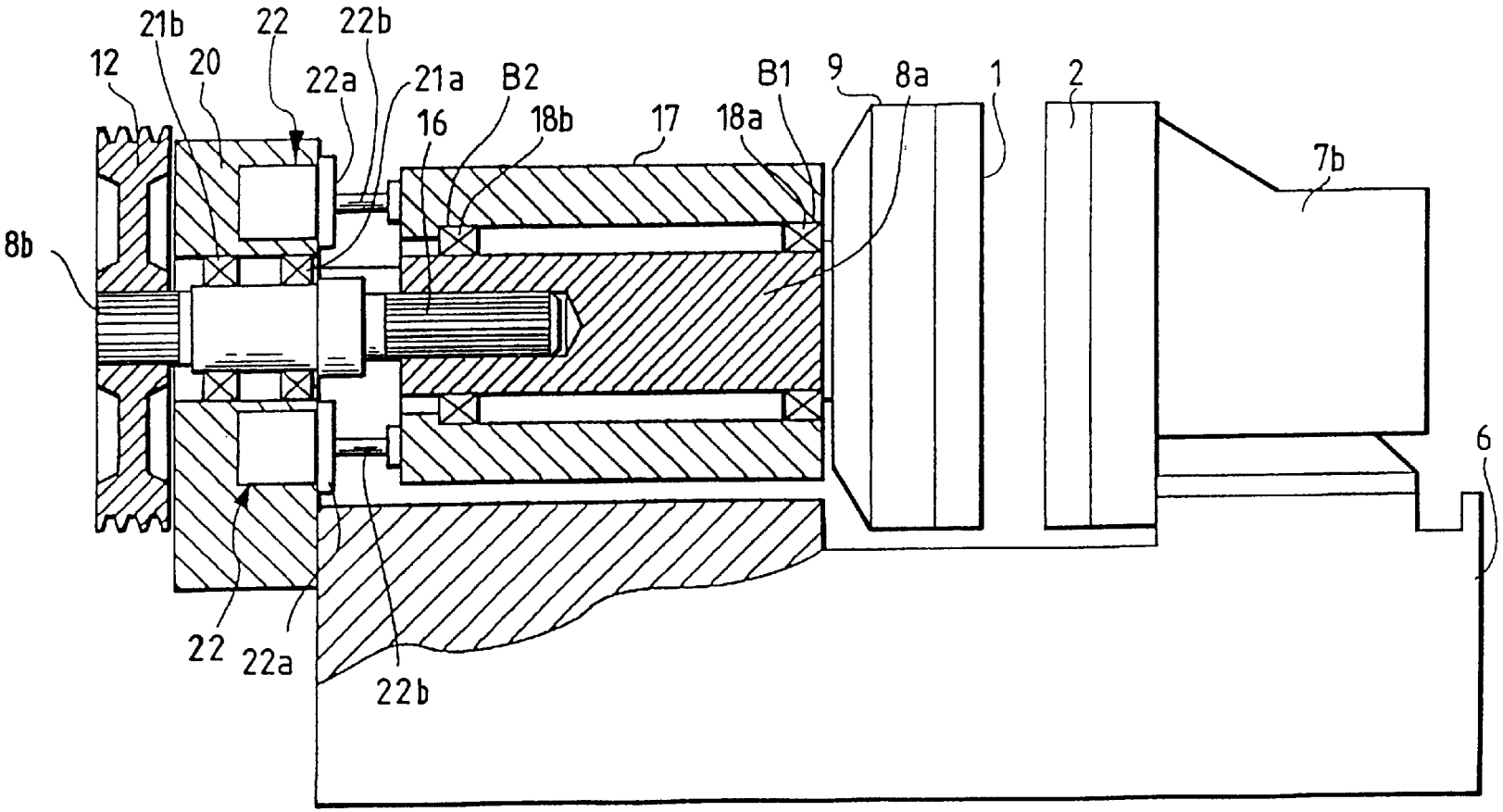
FIG. 8 is a longitudinal cross section of the principal elements of the ball polishing apparatus illustrated in FIG. 7.
Figure 9:
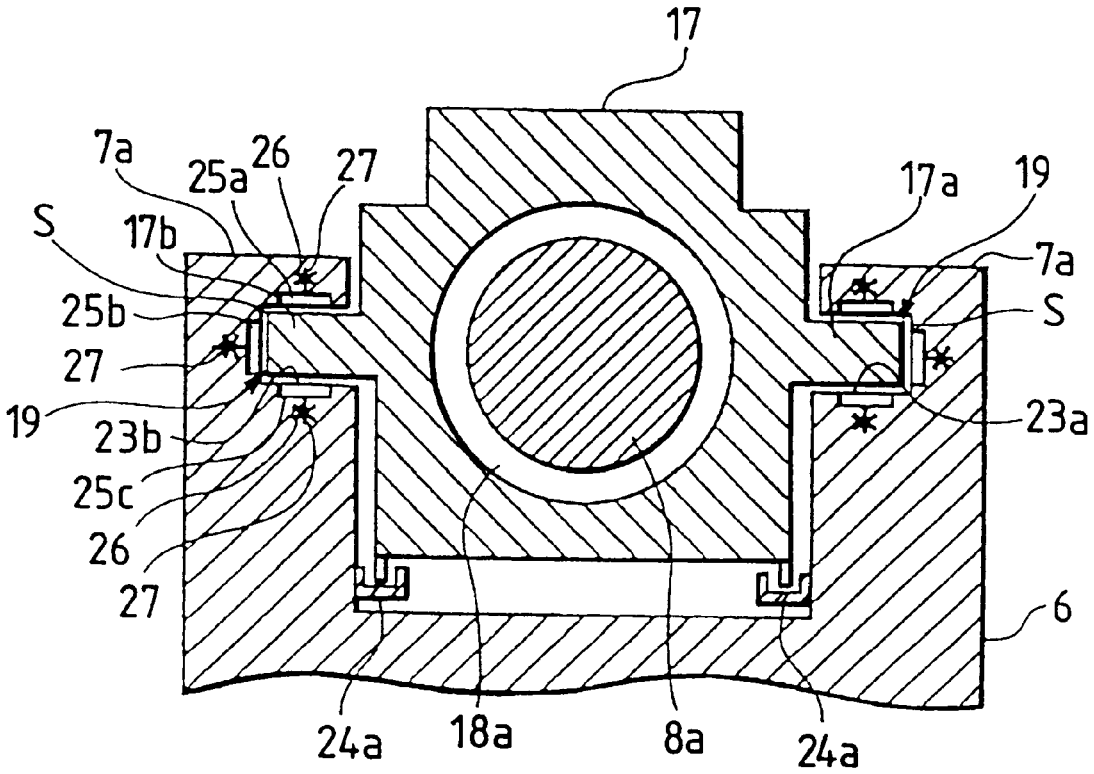
FIG. 9 is a cross section taken across line IX—IX in FIG. 7.

FIG. 7 is a longitudinal schematic side view illustrating the structure of the ball polishing apparatus according to the first embodiment of the present invention;

FIG. 8 is a longitudinal cross section of the principal elements of the ball polishing apparatus illustrated in FIG. 7; and FIG. 9 is a cross section taken across line A—A in FIG. 7.

Largely in reference to FIG. 8 of FIGS. 7 through 9, a first rotary shaft 8*a* and a second rotary shaft 8*b* are jointed to each other through a spline mechanism 16 so as to be axially slidable and to be rotatable in an integral manner. The rotary plate 1 is fixed to a flange 9 which is integrally formed with one end of the first rotary shaft 8*a*. The first rotary shaft 8*a* is supported by a guide 17 via rolling bearings 18*a* and 18*b* so as to be rotatable. As illustrated in FIG. 9, the guide 17 is supported by supports 7*a*, 7*a* so as to be slidable in the right and left directions in FIGS. 7 and 8 by a hydrostatic guide member 19 which forms a guide slide mechanism S. The supports 7*a*, 7*a* are integrally formed with a bed 6 so as to stand up along both of its sides on one longitudinal end (on the left-hand side in FIGS. 7 and 8). More specifically, as illustrated in FIG. 9, the hydrostatic guide member 19 is formed so that engagement projections 17*a* and 17*b* protruding from both sides of the guide 17 engage with engagement grooves 23*a* and 23*b* which are formed in the surfaces of the supports 7*a*, 7*a* so as to have a substantially C-shaped cross section, in a slidable manner.

The second rotary shaft 8*b* is supported in the center hole of a support member 20, which is provided on one longitudinal end of the bed 6, via rolling bearings 21*a* and 21*b* so as to be rotatable as well as to be axially fixed. A pulley 12 is attached to the end of the secondary rotary shaft 8*b* opposite to the spline mechanism 16. The guide 17 is axially slidable by means of a plurality of cylinder mechanisms 22 (two mechanisms in the first embodiment) which are uniformly spaced in the circumferential direction of the support member 20. Cylinders 22*a* of the cylinder mechanisms 22 are fixed to the support member 20, and external ends of piston rods 22*b* are fixed to the guide 17. A fluid-pressure (hydraulic) chamber provided in the cylinder 22*a* of each cylinder mechanism 22 is connected to a non-illustrated liquid-operated (hydraulic) circuit, thereby rendering the piston rod 22*b* axially slidable together with the guide 17, the first rotary shaft 8*a*, and the rotary disk 1 in an integrated manner.

Each of the cylinder mechanisms 22 serves as an actuator for sliding the guide 17 in the right and left directions in FIGS. 7 and B. A machining pressure used for polishing balls is also received from the cylinder mechanisms 22. The guide 17 is guided so as to travel (slide) back and forth (in the right and left directions in FIGS. 7 and 8) by means of the guide slide mechanism S formed into a hydrostatic slide. That is, a load (P) generated by the cylinder mechanisms 22 becomes much larger than a frictional force (F) in the sliding direction which is caused by radial and moment loads in the vertical and horizontal directions resulting from the sliding of the guide 17, so that the frictional resistance can be ignored substantially. Therefore, it is possible to say that the load of cylinder mechanisms 22 acts on the balls as an actual machining pressure used for polishing balls, substantially exactly as they are.

Figure 10:
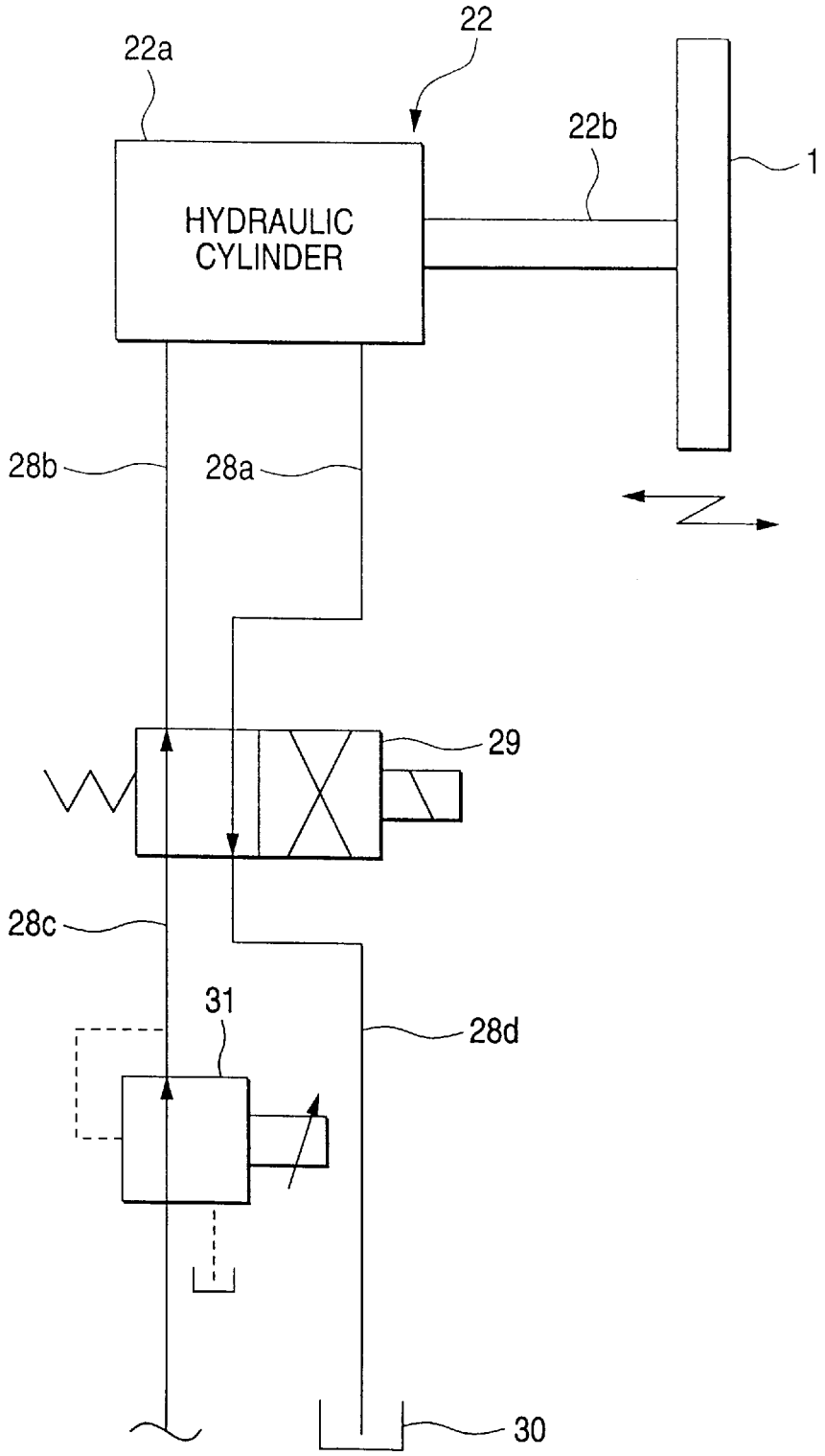
FIG. 10 is a block diagram illustrating a hydraulic circuit of the ball polishing apparatus for controlling a polishing pressure.

As illustrated in FIG. 10, the cylinder mechanisms 22 are each connected to a liquid-operated (hydraulic) circuit which regulates a machining pressure used for polishing balls. As is evident from the drawing, conduits 28*a* and 28*b* connected to respective ports of the cylinder 22*a* are connected to respective ports of a directional control valve 29. Further, the directional control valve 29 is connected to conduits 28*c* and 28*d*. The conduit 28*c* is connected to a liquid-pressure (hydraulic) circuit, which uses a non-illustrated pump, via an electromagnetic proportional control valve 31, and the conduit 28*d* is connected to a tank 30. The electromagnetic proportional control valve 31 regulates a pressure for feeding a hydraulic fluid to the cylinder 22*a*, whereby the horizontal movement of the rotary plate 1 in FIG. 10 is controlled via the piston rod 22*b*. As a result, the polishing pressure is controlled for each of three stages; i.e., a roughing process, a semi-finishing process, and a finishing process.

With regard to the guide slide mechanism S, as illustrated in FIG. 7, a plurality of grooves 24 for collecting a hydraulic fluid (oil) are formed in the internal surfaces of the engagement grooves 23*a* and 23*b* at given intervals in the direction in which the guide 17 slides. These grooves 24 are arranged into a substantially C-shaped layout along the internal surface of each of the engagement grooves 23*a* and 23*b*. The hydraulic fluid leaked to the grooves 24 from hydrostatic pockets 25*a*, 25, and 25*c*, which will be described later, is collected by way of channels 24*a* axially provided below the guide 17. As illustrated in FIG. 7, the rectangular hydrostatic pockets 25*a*, 25*b*, and 25*c* are formed between the pair of grooves 24 in the respective internal surfaces of each of the engagement grooves 23*a* and 23*b* in the direction in which the guide 17 slides. As illustrated in FIG. 9, the hydrostatic pockets 25*a*, 25*b*, and 25*c* are each connected to a fluid-pressure (hydraulic pressure) supply section via a channel 27 with an orifice 26 provided between the hydrostatic pocket and the channel and via a non-illustrated pipe.

In FIGS. 7 and 8, another support 7*b* is provided on the right-hand side of the bed 6, and a fixed plate 2 is attached to the support 7*b* so as to be opposite to the rotary plate 1.

Figure 3:
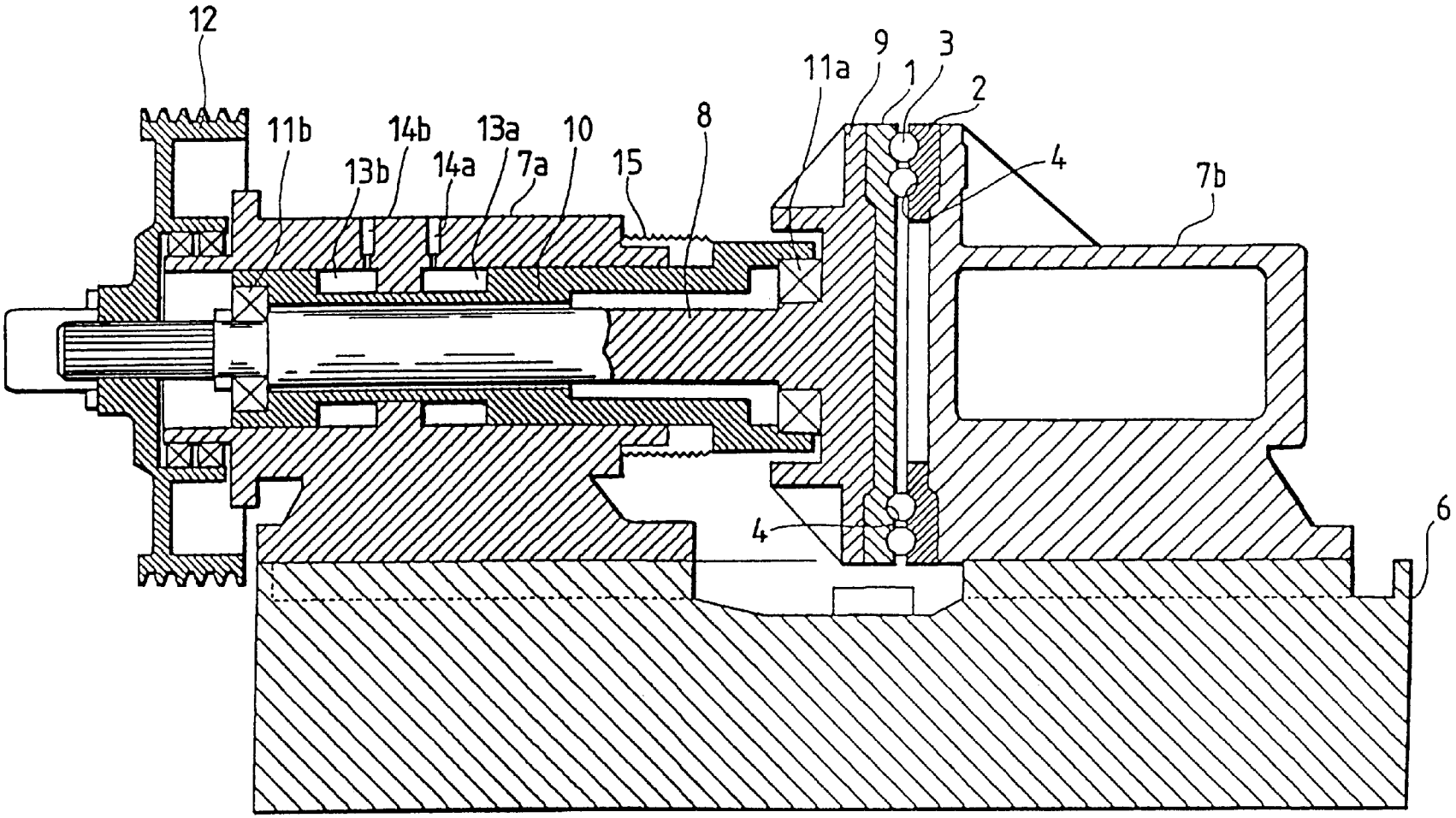
FIG. 3 PRIOR ART
FIG. 3 is a longitudinal cross section of one example of the conventional ball polishing apparatus.
Figure 4:
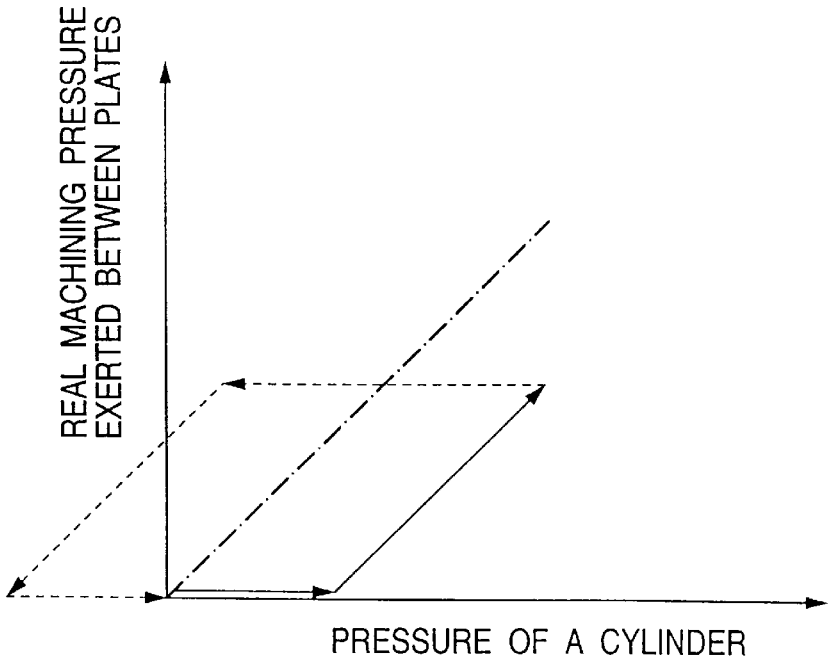
FIG. 4 PRIOR ART
FIG. 4 is a plot illustrating hysteresis of a polishing pressure of the conventional ball polishing apparatus.
Figure 5:
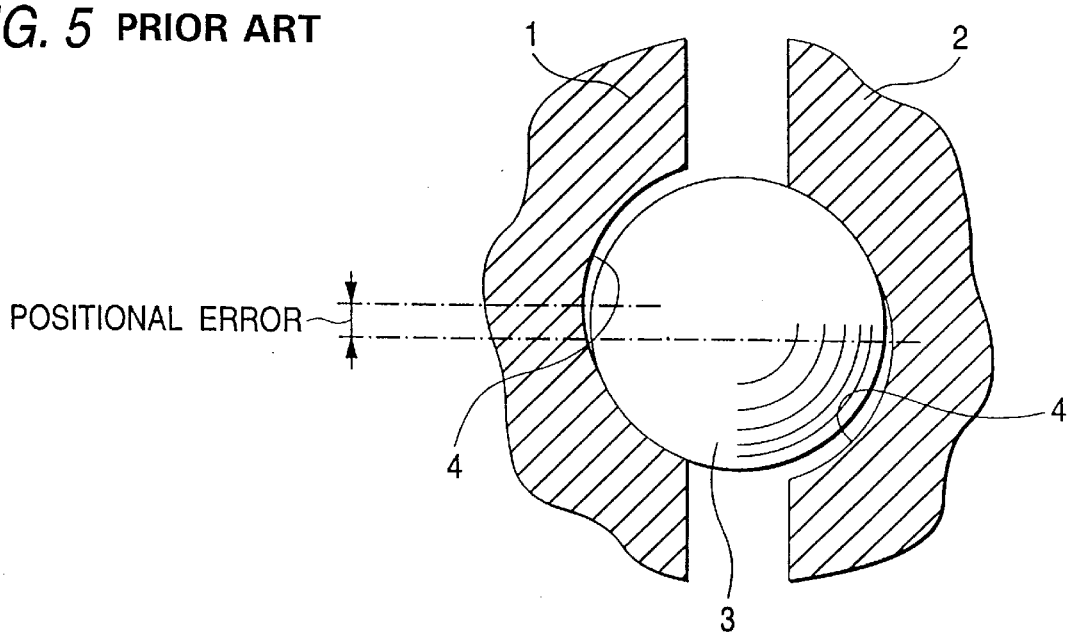
FIG. 5 PRIOR ART
FIG. 5 is a schematic representation for describing a problem associated with the conventional ball polishing apparatus.
Figure 6A:
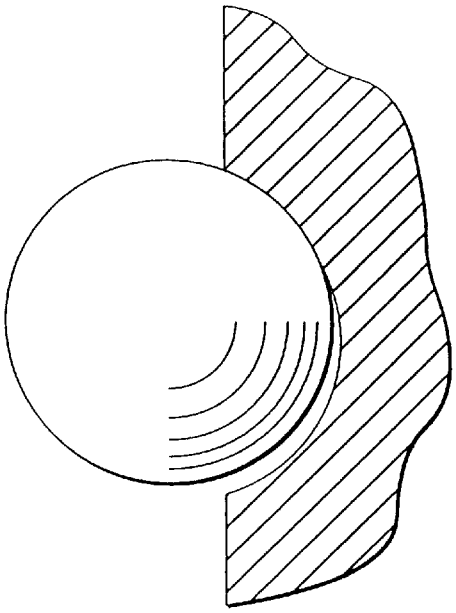
FIG. 6A PRIOR ART
FIGS. 6A and 6B are schematic representations for describing the problem associated with the conventional ball polishing apparatus.
Figure 6B:
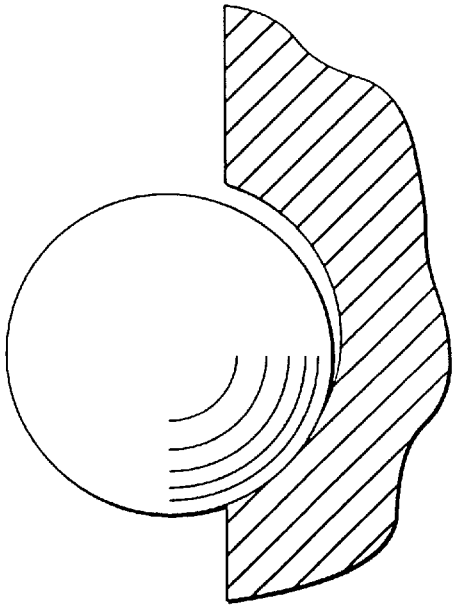
FIG. 6B PRIOR ART

In the ball polishing apparatus of the first embodiment, since the guide slide mechanism S is formed into a hydrostatic slide, hysteresis such as it is illustrated in FIG. 3 and develops in the conventional sliding guide structure or roll guide structure is eliminated. Consequently, a real machining pressure used for actual polishing operations accurately matches a preset machining pressure. The "real machining pressure" used herein refers not to an additional force received from the cylinder mechanisms 22 but to a load really exerted on the balls during the polishing process.

Next, the operation of the ball polishing apparatus according to the first embodiment will be described.

Figure 1:
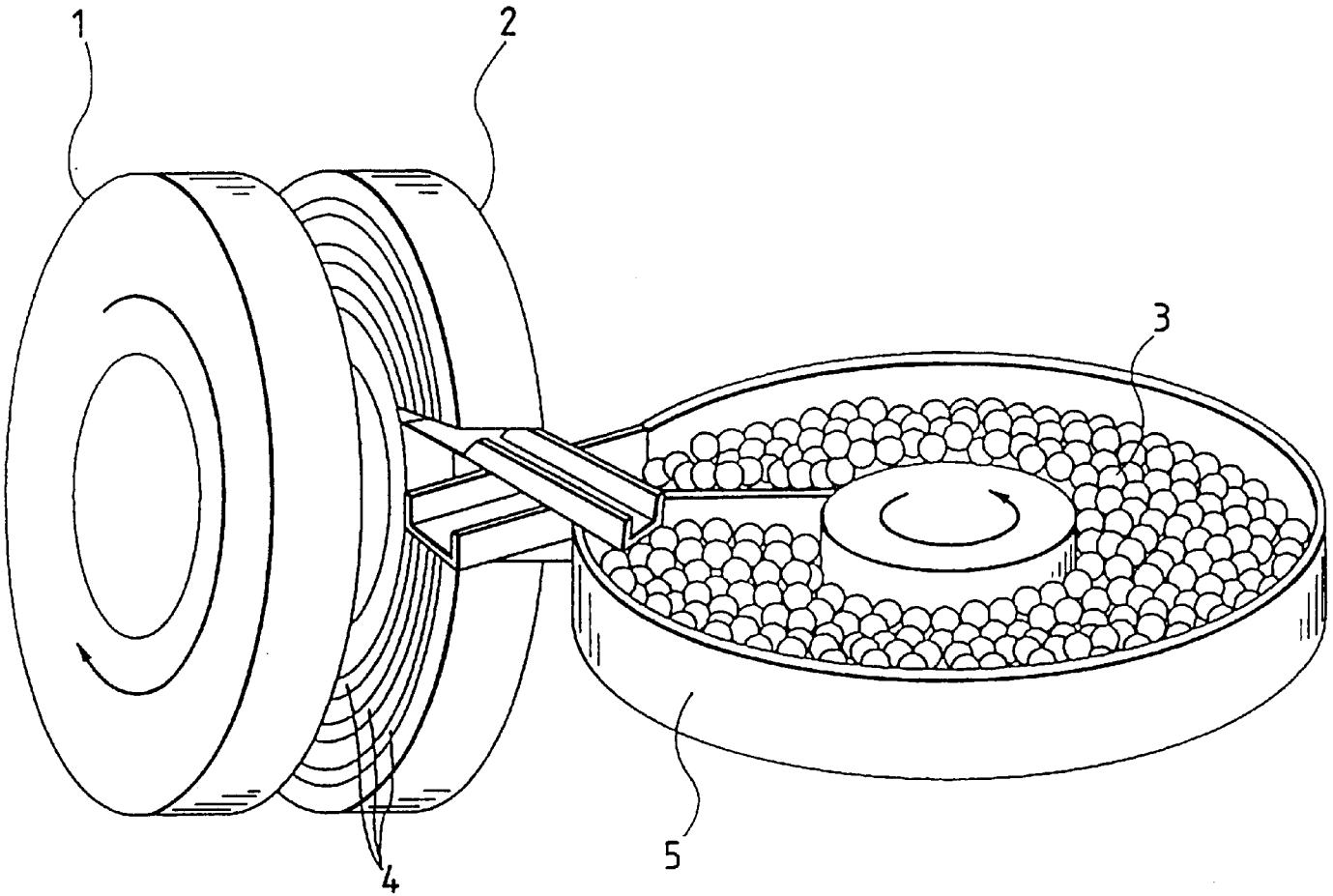
FIG. 1 PRIOR ART
FIG. 1 is a perspective view of the principal elements of a conventional ball polishing apparatus.
Figure 2A:
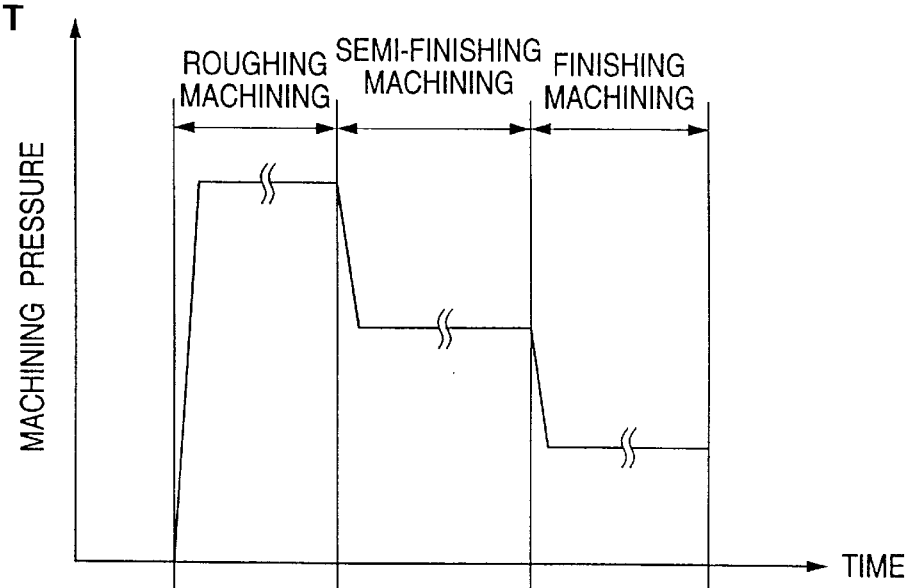
FIG. 2A PRIOR ART
FIGS. 2A and 2B are plots illustrating the relationship between a ball polishing pressure control pattern, the amount of variations in the diametrical size of a ball in the conventional ball polishing apparatus, and time.
Figure 2B:
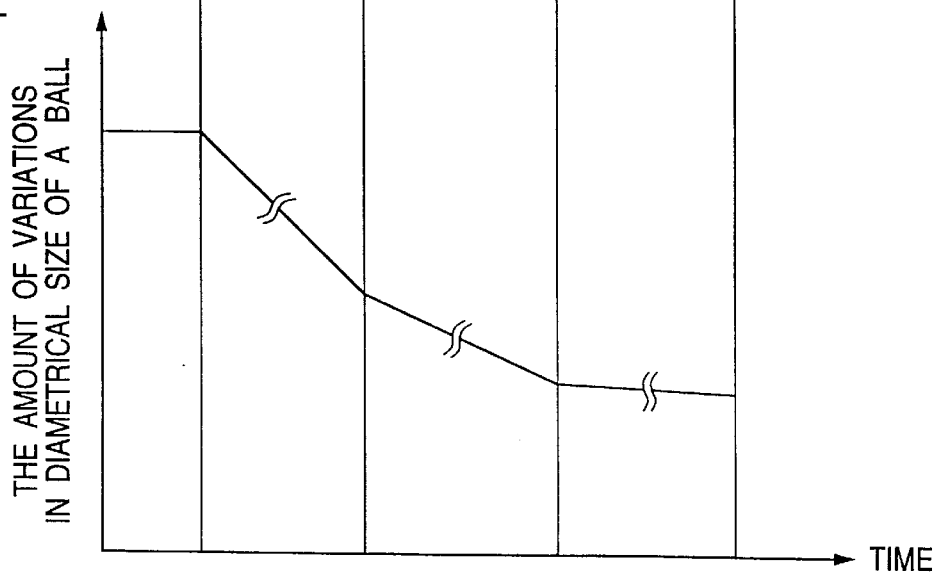
FIG. 2B PRIOR ART

In terms of the basic polishing operations, the ball polishing apparatus of the present embodiment is the same as the conventional ball polishing apparatus. Specifically, when the pulley 12 is rotated by a non-illustrated motor, the first and second rotary shafts 8*a* and 8*b*, and the rotary plate 1 rotate together with the pulley 12. At this time, if the piston rods 22*b* are moved in a projecting direction (in the rightward direction in FIGS. 7 and 8) by actuating the cylinder mechanisms 22, the guide 17 slides rightwards in FIGS. 7 and 8 together with the piston rods 22*b*. As a result, while rotating, the rotary plate 1 comes into close proximity to the fixed plate 2 in a pressurizing manner. As illustrated in FIG. 1, balls 3 conveyed between the plates 1 and 2 by a conveyor 5 are polished lot by lot. In practice, the balls 3 are polished by a grindstone provided at least one of the plates 1 and 2 or by abrasive grains mixed into a working fluid which is applied to the balls 3 sandwiched between the metal plates 1 and 2 during the polishing operation.

In a space between the engagement projections 17*a* and 17*b* of the guide 17 and the engagement grooves 23*a* and 23*b* of the supports 7*a*, 7*a* provided on the bed 6, a high-pressure working fluid (oil) (e.g., under ten atmospheric pressures) is supplied to the hydrostatic pockets 25*a* to 25*c* from the channels 27 via the orifices 26. As a result of the action of the pressure on the top, bottom, and side surfaces of the engagement projections 17*a* and 17*b*, the guide 17 is supported within the engagement grooves 23*a* and 23*b* of the supports 7*a* and 7*b* without substantial frictional resistance.

The working fluid leaked from the circumference of each of the hydrostatic pockets 25*a* to 25*c* may be collected by the fluid-pressure (hydraulic pressure) supply section by drawing it through use of a non-illustrative suction pump via the channels 24*a* of the grooves 24.

In the ball polishing apparatus of the first embodiment, the guide slide mechanism S of the guide 17 is formed into a hydrostatic slide, and hence the hysteresis developing when the polishing pressure is regulated becomes decreased. Further, the loads exerted on the balls 3 during the stable polishing operation becomes stable. For these reasons, the machining pressure required in each of the machining processes can be controlled with a high degree of accuracy, enabling realization of a machining speed, a diametrical size, and a machining accuracy corresponding to each processing step.

Figure 11:
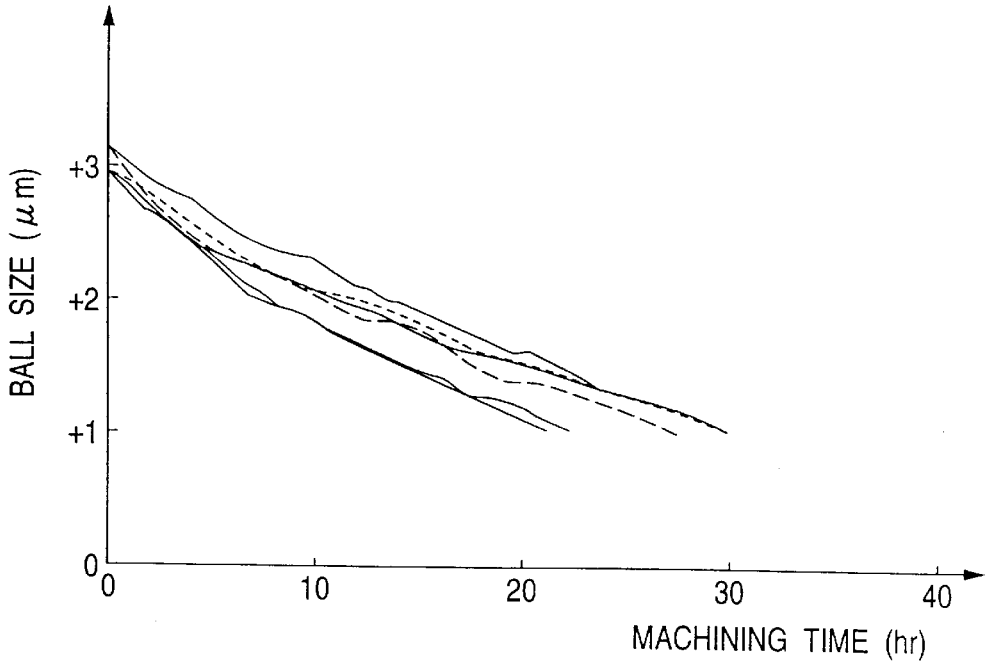
FIG. 11 is a plot illustrating ball polishing curves for respective lots of the ball polishing apparatus according to the first embodiment.
Figure 12:
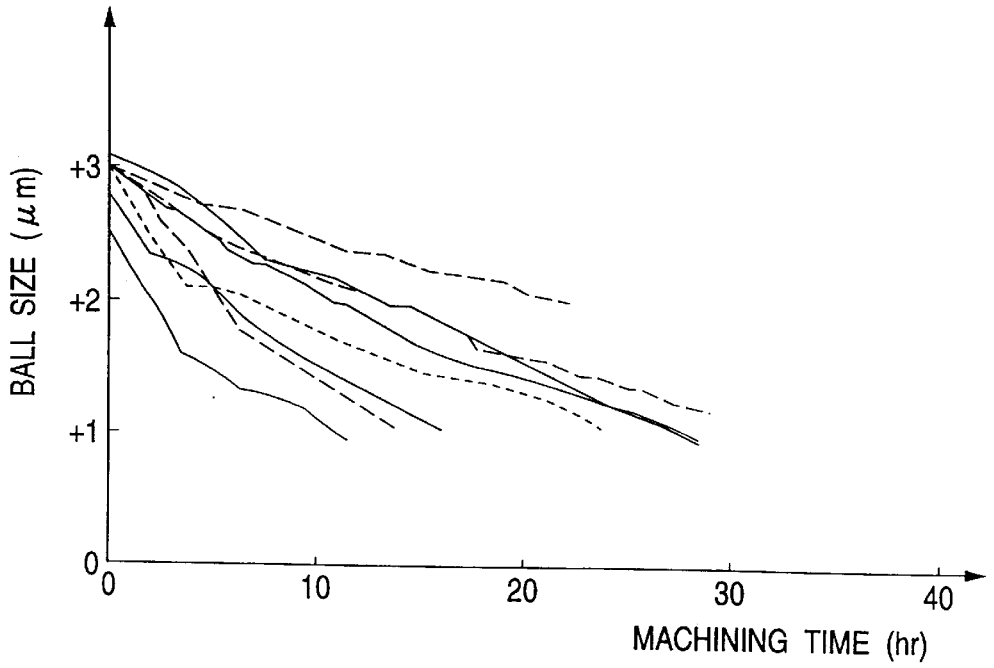
FIG. 12 PRIOR ART
FIG. 12 is a plot illustrating ball polishing curves for respective lots of the conventional ball polishing apparatus.

As illustrated in FIG. 11, the time required to machine the balls of each lot becomes stable, and the difference between lots with regard to the degree of finishing can be reduced. FIG. 11 is a plot illustrating ball polishing curves for respective lots of the ball polishing apparatus according to the first embodiment. Each of the curves represents a mean value for each lot. From a comparison between the ball polishing curves illustrated in FIG. 11 and ball polishing curves for respective lots of the conventional ball polishing apparatus illustrated in FIG. 12, it is evident that the present invention can reduce the difference among the lots with regard to the degree of finishing to a much greater extent.

The guide slide mechanism S formed into a hydrostatic slide has already been widely used with a machining apparatus, such as an apparatus for grinding the external surface of a ring, which controls the positions of the slide corresponding to the size of a workpiece with a high degree of accuracy. However, in the case of a ball polishing apparatus which machines articles to be machined with a high degree of accuracy by regulating a machining pressure, a very high degree of accuracy of position control of the slide is not required. Further, such a high degree of accuracy of position control of the slide is not necessary to achieve a conventionally required degree of machining accuracy of the balls. For these reasons, there is no instance of use of the hydrostatic slide in the ball polishing apparatus.

According to the ball polishing apparatus of the first embodiment, a machining pattern can be controlled with a high degree of accuracy, and hence the difference in diametrical size among the balls in one lot can be reduced to a much greater extent. Furthermore, the manufacture of balls having a desired size is ensured.

Second Embodiment

With reference to FIGS. 13 through 17, a second embodiment of the present invention will be described. The present embodiment is directed to a ball polishing apparatus in which the bearing mechanism of the first rotary shaft 8*a* is made by a combination of hydrostatic radial bearings B1 and B2, and a hydrostatic thrust bearing B3.

Figure 13:
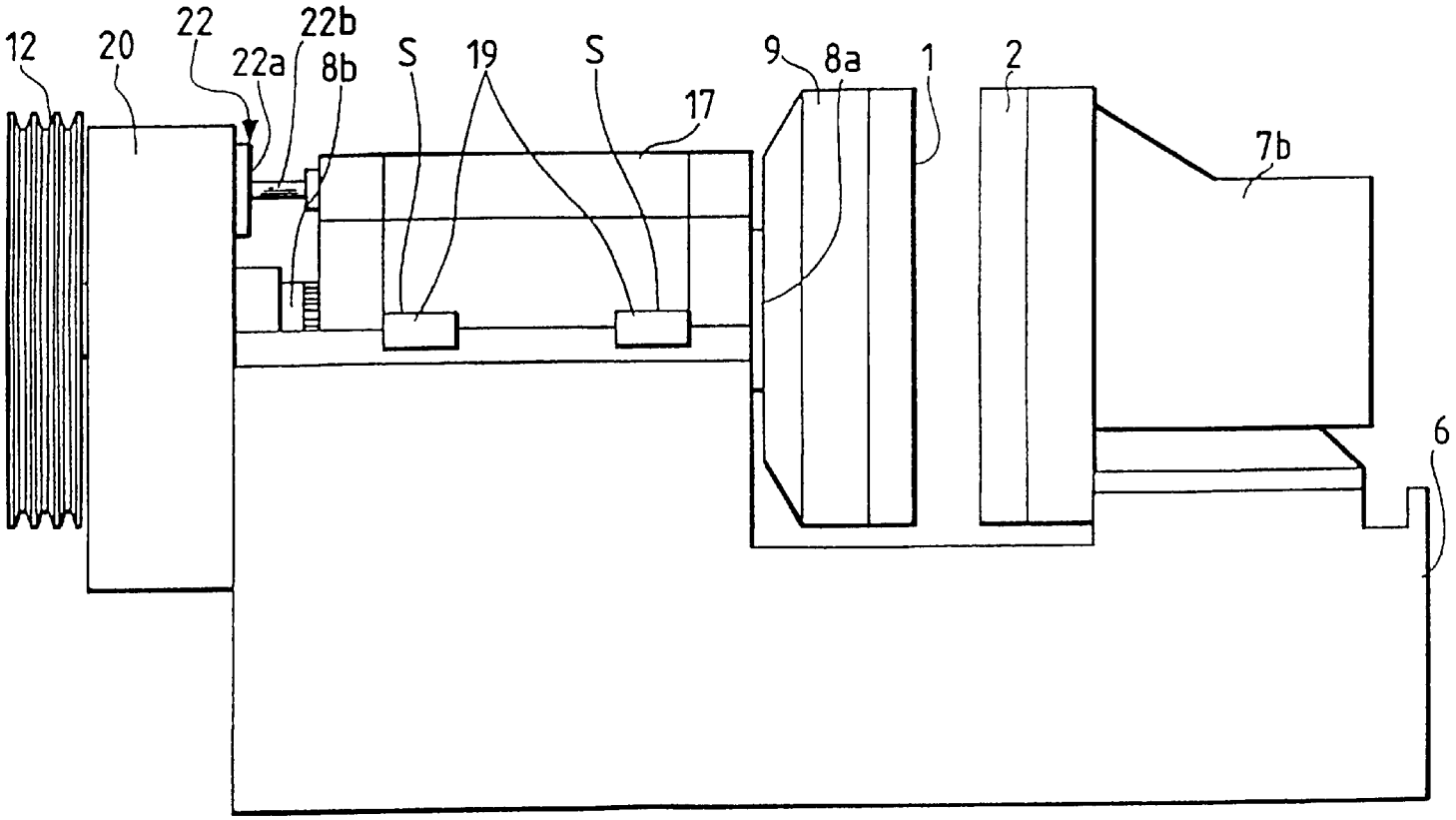
FIG. 13 is a longitudinal schematic side view of a ball polishing apparatus according to a second embodiment of the present invention.
Figure 14:
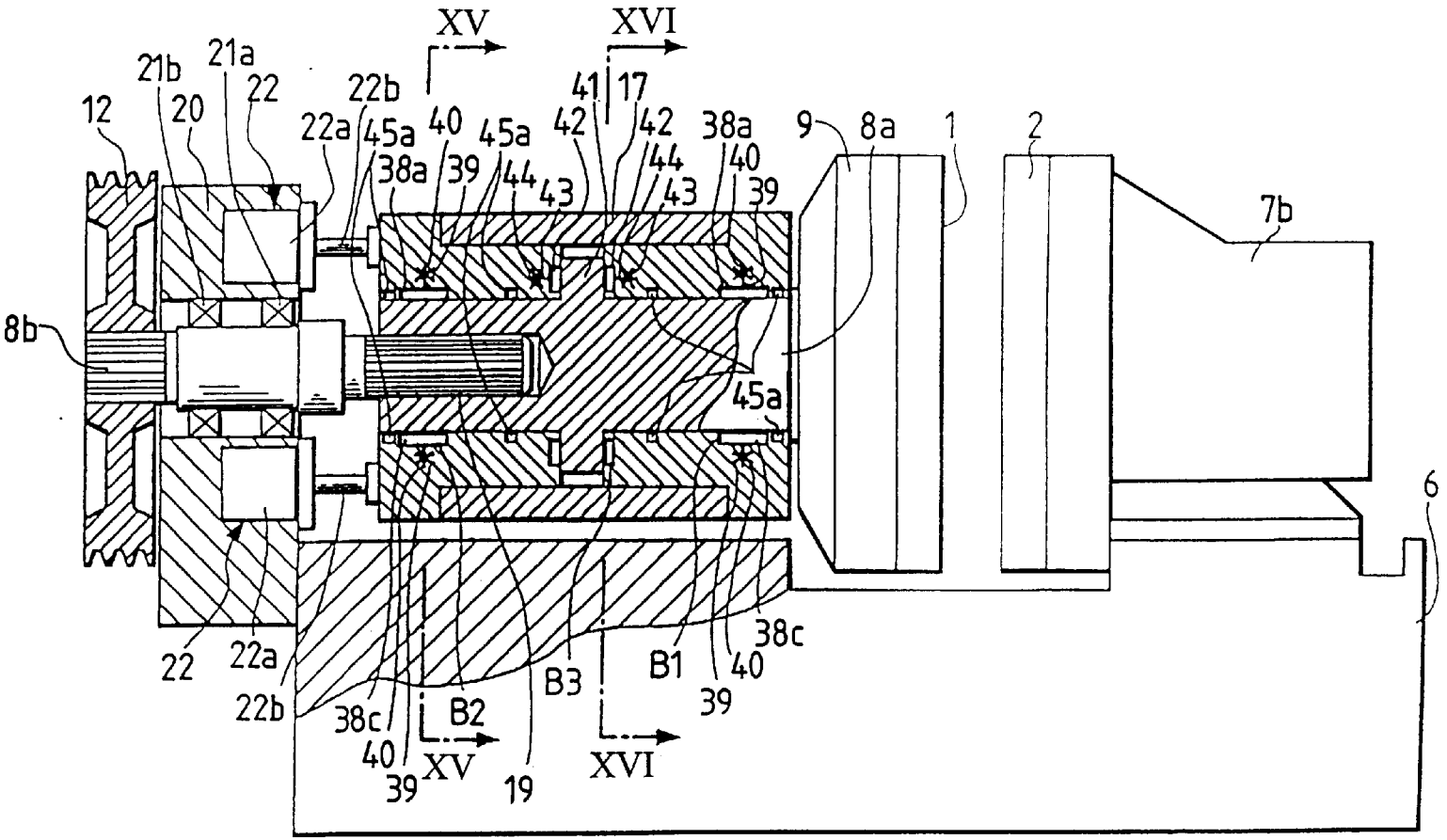
FIG. 14 is a longitudinal cross section of the principal elements of the ball polishing apparatus illustrated in FIG. 13.
Figure 15:
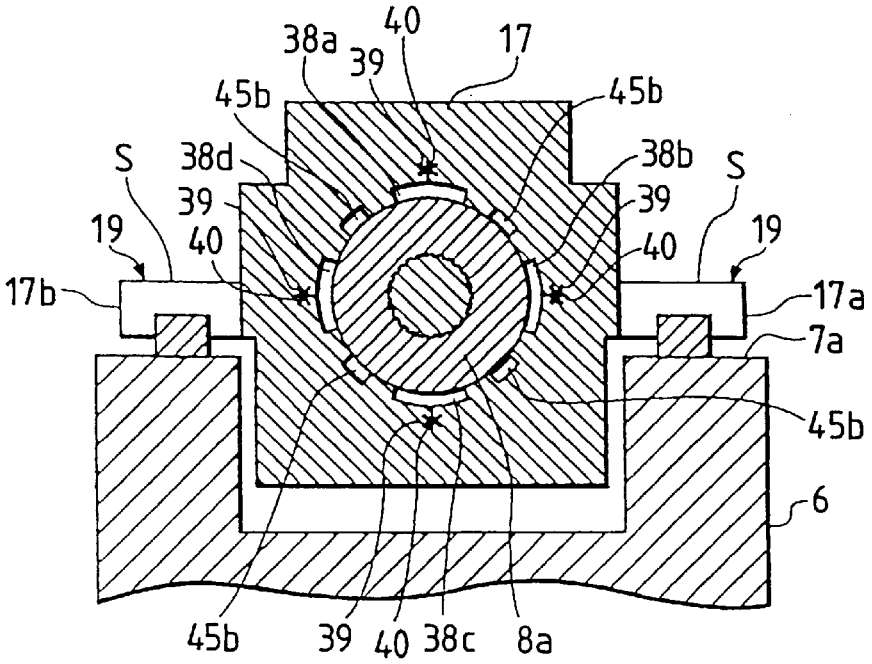
FIG. 15 is a cross section taken across line XV—XV in FIG. 14.
Figure 16:
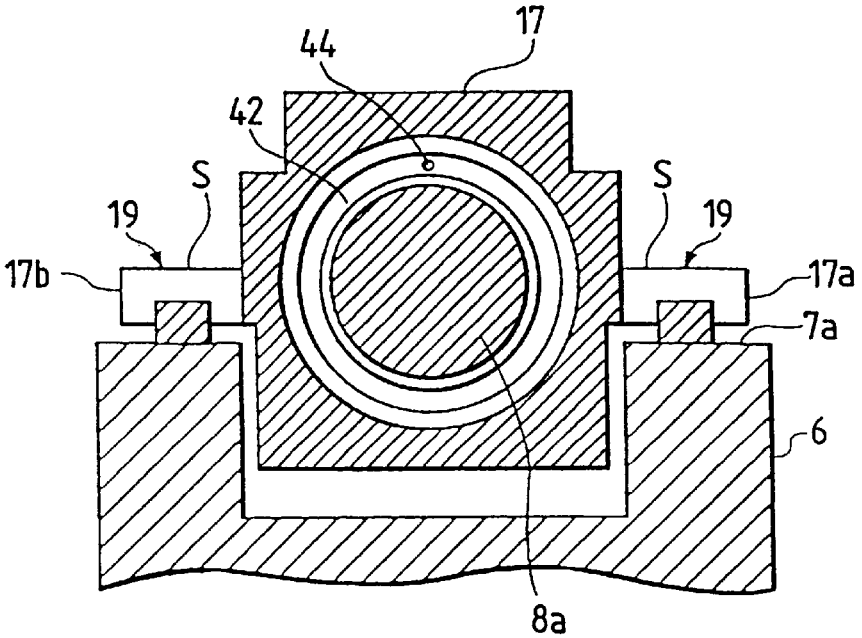
FIG. 16 is a cross section taken across line VVI—XVI in FIG. 14.

FIG. 13 is a longitudinal schematic side view of a ball polishing apparatus according to a second embodiment of the present invention; FIG. 14 is a longitudinal cross section of the principal elements of the ball polishing apparatus illustrated in FIG. 13,; FIG. 15 is a cross section taken across line D—D in FIG. 14; and FIG. 16 is a cross section taken across line E—E in FIG. 14. In FIGS. 13 through 16, the functional elements which are the same as those of the first embodiment illustrated in FIGS. 7 through 9 will be assigned with the same reference numerals.

The ball polishing apparatus of the second embodiment is different from the previously-described conventional ball polishing apparatus in that the bearing mechanism of the first rotary shaft 8*a* is made by a combination of hydrostatic radial bearings B1 and B2, and a hydrostatic thrust bearing B3. More specifically, as illustrated in FIG. 15, a set of hydrostatic pockets 38*a*, 38*b*, 38*c*, and 38*d* are provided at predetermined intervals in the internal circumferential surface of the guide 17 on both of its axial ends. The hydrostatic pockets 38*a* to 38*d* are rectangularly formed while their longitudinal axes are in line with the axial direction of the guide 17. The hydrostatic pockets 38*a* to 38*d* are connected to the fluid-pressure (hydraulic pressure) supply source (not shown) via channels 40 with orifices 39 being interposed between the pockets and the channels. As illustrated in FIG. 14, a flange 41 is formed in a substantially intermediate portion of the first rotary shaft 8*a* in its axial direction. Hydrostatic pockets 42 are formed in the surfaces of the guide 17 opposite both side surfaces of the flange 41. As illustrated in FIG. 16, each of the hydrostatic pockets 42 is formed into an annular groove and is connected to the fluid-pressure supply section via a channel 44 with an orifice 43 being interposed between the hydrostatic pocket and the channel.

Annular grooves 45*a* are formed on both sides of the set of hydrostatic pockets 38*a* to 38*d* formed in the internal circumferential surface of the guide 17, and grooves 45*b* are formed so as to connect together the annular grooves 45*a* with the hydrostatic pockets 38*a* to 38*d* between them. The bottom of each of the grooves 45*a* is connected to a non-illustrated channel, thereby collecting the working fluid (oil) directly leaked into the grooves 45*a* from the hydrostatic pockets 38*a* to 38*d* and the hydrostatic pockets 42 and the working fluid (oil) leaked into the grooves 45*a* from the hydrostatic pockets 38*a* to 38*d* via the channels 45*b* through use of a non-illustrated working fluid tank.

In the ball polishing apparatus of the second is embodiment having the foregoing structure, a high-pressure working fluid (oil) (e.g., under ten atmospheric pressures) is supplied to the hydrostatic pockets 38*a* to 38*d* and to the hydrostatic pockets 42 from the channels 40 and 44 via the orifices 39 and 43 between the outer circumferential surface of the first rotary shaft 8*a* and the internal circumferential surface of the guide 17. As a result of the action of the pressure on the outer circumferential surface of the first rotary shaft 8*a*, the first rotary shaft 8*a* is rotatably supported within the guide 17 without substantial frictional resistance. Consequently, the rotary plate 1 can rotate with a high degree of accuracy in both the radial direction and in the direction of thrust.

Figure 17:
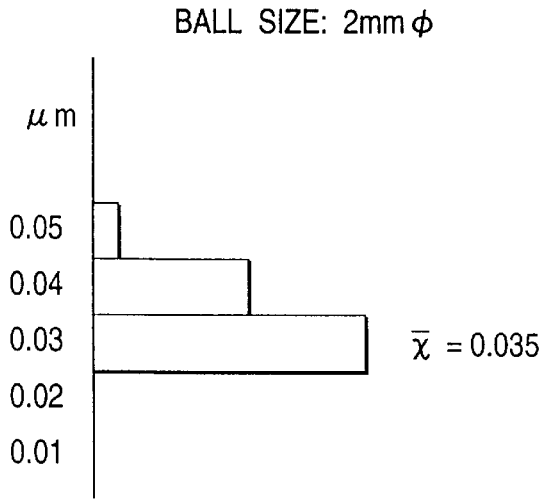
FIG. 17 is a diagram illustrating the distribution of sphericity of the ball polishing apparatus illustrated in FIG. 13.

Data on the distribution of sphericity illustrated in FIG. 17 is obtained, provided that the guide slide mechanism S of the guide 17 is formed into a rolling guide, and the bearing mechanism of the rotary plate 1 is made up of the hydrostatic radial bearings B1 and B2 and the hydrostatic thrust bearing B3. From the data illustrated in FIG. 17, it is apparent that the balls used for obtaining the data are balls which are commonly used as ball bearings of a hard disk drive and have a diameter of 2 mm, and that they are significantly improved in view of the distribution of sphericity with reference to a sphericity of 0.06 micrometers of the maximum standard "Class 3", which is the currently-highest standard for steel balls (spheres).

In the case where the guide slide mechanism S of the guide 17 is a hydrostatic guide slide, it is possible to expect further improvements in the sphericity and in the range of distribution of the sphericity illustrated in FIG. 17 as a result of stabilization of the ball polishing curves illustrated in FIG. 11.

In the second embodiment, the guide slide mechanism S of the guide 17 may be either a rolling guide slide or a hydrostatic guide slide. However, it is desirable that the guide slide mechanism be a hydrostatic guide slide.

A capillary restrictor or a control restrictor may be used in lieu of the orifices 39 and 43.

Third Embodiment

Figure 18:
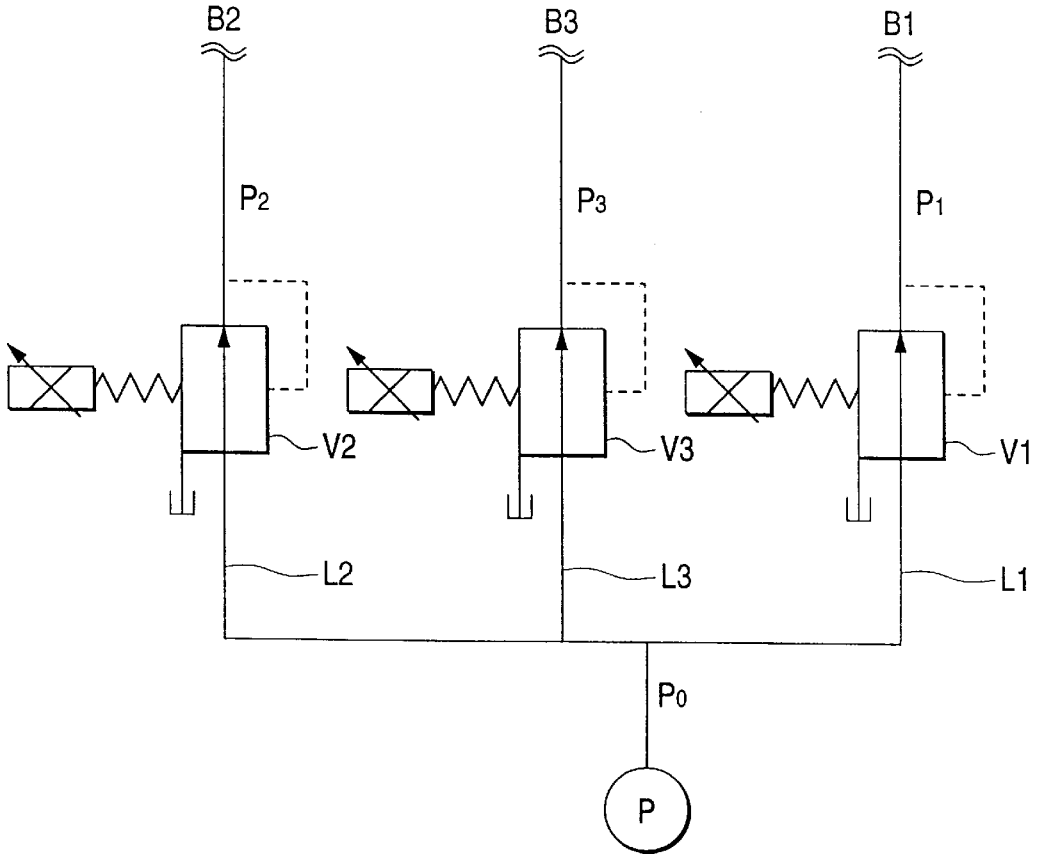
FIG. 18 is a circuit diagram illustrating the configuration of a circuit for supplying a hydraulic fluid to hydrostatic bearings in a ball polishing apparatus according to a third embodiment of the present invention.
Figure 19:
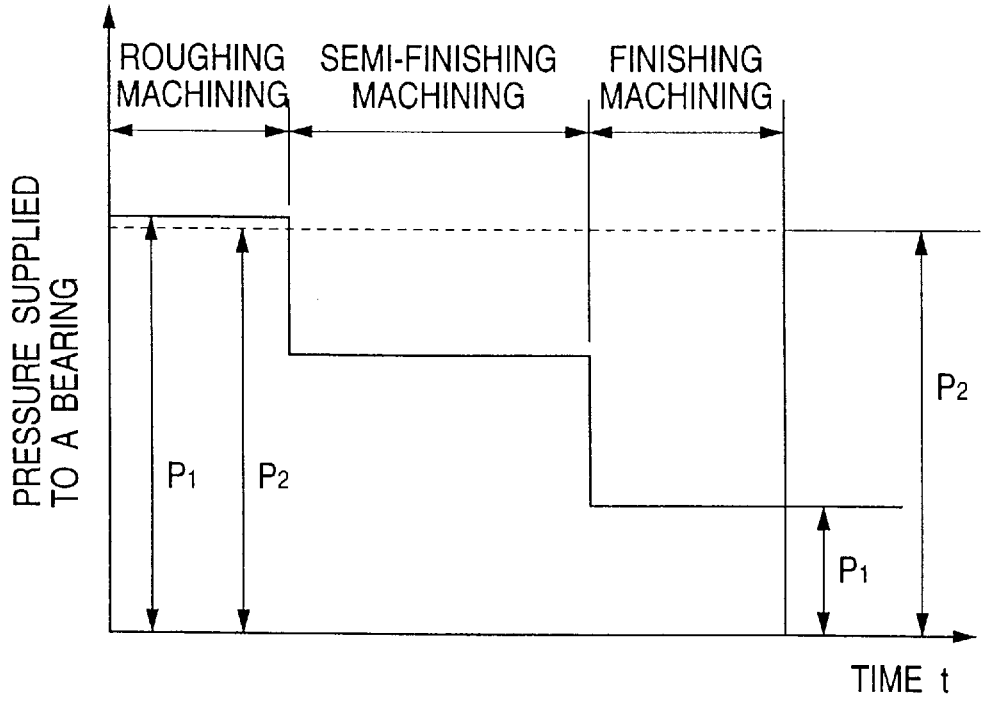
FIG. 19 is a plot illustrating the relationship between machining processes and a pressure for supplying the hydraulic fluid to the hydrostatic bearings in the ball polishing apparatus illustrated in FIG. 18.

With reference to FIGS. 18 and 19, a third embodiment of the present invention will be described. A ball polishing apparatus of the third embodiment is basically the same in structure as the ball polishing apparatus of the second embodiment illustrated in FIGS. 13 through 16, and hence these drawings will be also applied to the description of the third embodiment.

The third embodiment is directed to improve the accuracy of polishing of balls by enabling regulation of the shaft support rigidity of the hydrostatic radial bearings B1, B2 and the hydrostatic thrust bearing B3 which form the bearing mechanism of the rotary plate 1, by polishing balls while the shaft support rigidity of the hydrostatic radial bearings B1 and B2 are regulated during the polishing process, by bringing the annular grooves 4 of the rotary plate 1 in alignment with the annular grooves 4 of the fixed plate 2 and with the balls stably fitted on the bottom of the annular grooves 4 of the fixed plate 2.

As illustrated in FIG. 18, rigidity regulation means for regulating the shaft support rigidity of the hydrostatic radial bearings B1 and B2 is comprised of; e.g., pressure control valves V1, V2, and V3 such as electromagnetic proportional pressure-reducing valves respectively provided in three branch lines L1, L2, and L3 connected to a pump P. A delivery side of the first pressure regulation valve V1 is connected to a circuit of the first hydrostatic radial bearing B1; a delivery side of the second pressure regulation valve V2 is connected to a circuit of the second hydrostatic radial bearing B2; and a delivery side of the third pressure regulation valve V3 is connected to a circuit of the hydrostatic thrust bearing B3.

The working fluid (oil) discharged from the pump P under pressure $P_0$ is supplied to the respective hydrostatic pockets 38*a* to 38*d* and 42 that form the hydrostatic radial bearings B1 and B2 and the hydrostatic thrust bearing B3, via the orifices 39 and 43 after having been regulated to arbitrary pressures P1, P2, and P3 by the pressure regulation valves V1, V2, and V3.

The shaft support rigidity K of the hydrostatic radial bearings B1 and B2 is substantially proportional to the supply pressures P1 and P2. Accordingly, there is provided an example in which the shaft support rigidity K of the hydrostatic radial bearings B1 and B2 is regulated by the supply pressures P1 and P2.

FIG. 19 is a plot illustrating an example in which the ball polishing apparatus of the third embodiment controls the pressures P1 and P2 supplied to the respective hydrostatic radial bearings B1 and B2 in ordinary three steps; i.e., a roughing step, a semi-finishing step, and a finishing step.

In FIG. 19, the pressure supplied to the cylinders 22*a* is held at a high pressure during the roughing operation in order to increase the loads exerted on the balls. In this state, the pressures P1 and P2 supplied to the respective hydrostatic radial bearings B1 and B2 are also retained at high pressures, so that the rotary shaft 8*a* is retained while the shaft support rigidity K of the hydrostatic radial bearings B1 and B2 is increased. Then, the balls are forcefully polished to a desired size with a high degree of accuracy.

During the semi-finishing operation, the pressure supplied to the cylinders 22*a* is held at a low pressure so as to reduce the loads exerted on the balls. In this state, the pressure P1 supplied to the first hydrostatic radial bearing B1 on the front side (in the right-hand side in FIG. 14) of the ball polishing apparatus is also held at a low pressure, so that the rotary shaft 8*a* is retained while the shaft support rigidity K of the first hydrostatic radial bearing B1 is reduced. Then, the balls are polished to the desired size with desired accuracy.

The efficiency of machining of the balls is reduced to finely control the size and accuracy during the finishing operation, and therefore the pressure supplied to the cylinders 22*a* is held in a further lower pressure, thereby further reducing the loads exerted on the balls. In this state, the pressure P1 supplied to the first hydrostatic radial bearing B1 is held in a further lower pressure, so that the rotary shaft 8*a* is retained while the shaft support rigidity K of the first hydrostatic radial bearing B1 is reduced further. Then, the balls are polished to the desired size with the desired accuracy.

As a result, the influence of the accuracy of rotation affecting the machining portions of the rotary plate 1 18 reduced. If the rotary plate 1 is rotated along the axis of rotation defined by the annular grooves 4 formed in the plates 1 and 2 and by the balls sandwiched between the annular grooves 4, an abnormal force exerted on the balls is reduced, enabling superior finishing of the balls.

In the ball polishing apparatus of the third embodiment, the accuracy of polishing of the balls can be improved by, during the course of the polishing process, regulating the shaft support rigidity of the hydrostatic radial bearings B1 and B2 which are the bearing mechanism of the rotary plate 1, and particularly at the time of the finishing process bringing the annular grooves of the rotary plate 1 in alignment with the balls fitted in the annular grooves 4 of the fixed plate 2.

Fourth Embodiment

Next, a fourth embodiment of the present invention will be described in reference to FIG. 20. A ball polishing apparatus of the fourth embodiment is the same as in basic structure as that of the second embodiment illustrated in FIGS. 13 through 16. Further, a control circuit of the rigidity regulation means for regulating the shaft support rigidity of the hydrostatic radial bearings B1 and B2 is the same in configuration as that of the third embodiment illustrated in FIG. 18. Therefore, these drawings will also be applied to the description of the fourth embodiment.

Figure 20:
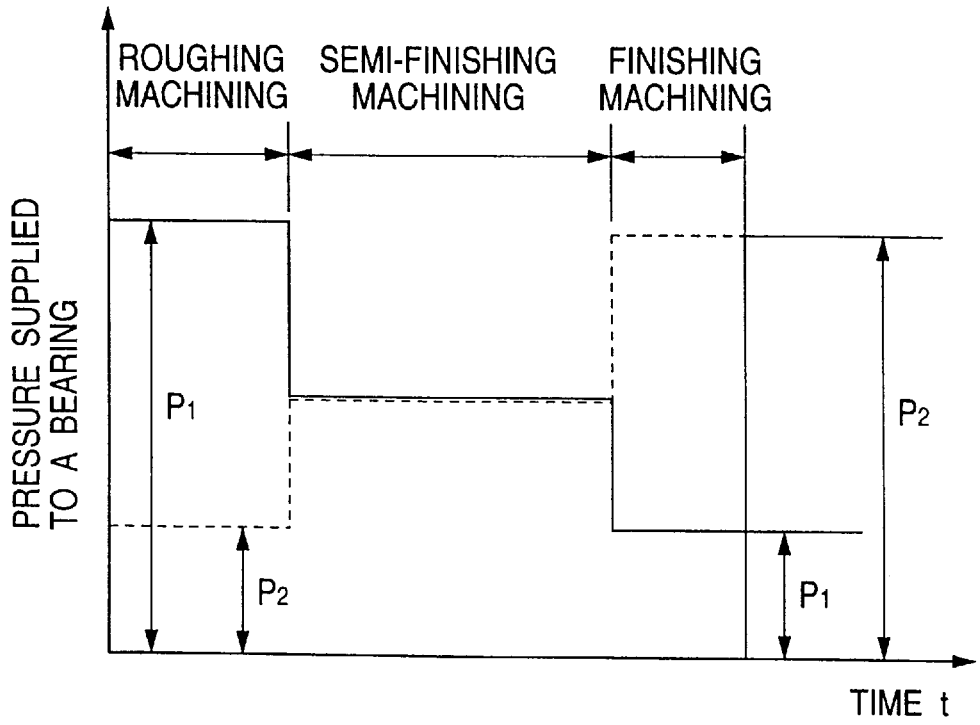
FIG. 20 is a plot illustrating the relationship between machining processes and a pressure for supplying the hydraulic fluid to hydrostatic bearings in a ball polishing apparatus according to a fourth embodiment of the present invention.

FIG. 20 is a plot illustrating an example in which the ball polishing apparatus of the fourth embodiment controls the pressures P1 and P2 supplied to the respective hydrostatic radial bearings B1 and B2 in ordinary three steps; i.e., a roughing step, a semi-finishing step, and a finishing step.

In practice, the rotary plate 1 has a self-weight. Therefore, in the case of the horizontal shaft type rotary shaft 8*a*, a machining portion of the ball polishing apparatus is situated in a lower position than a geometrical center position in proportion to the shaft support rigidity of the hydrostatic radial bearings B1 and B2 which form the bearing mechanism of the rotary plate 1. Accordingly, if the shaft support rigidity of the hydrostatic radial bearings B1 and B2 corresponding to the roughing process is changed at the time of the finishing process, the position of the rotary plate 1 changes also because of its self-weight.

Therefore, in the fourth embodiment, variations in the position of the rotary plate 1 occurred at the time of roughing operation are suppressed by regulating the shaft support rigidity of the hydrostatic radial bearings B1 and B2 of the bearing mechanism of the rotary shaft 8*a*.

More specifically, as shown in FIG. 20, the pressure supplied to the cylinders 22*a* is held in a high pressure at the time of the roughing process, thereby increasing the loads exerted on the balls. In this state, the pressure P1 supplied to the first hydrostatic radial bearing B1 on the front side (in the right-hand side in FIG. 14) of the ball polishing apparatus is held at a high pressure, so that the shaft support rigidity K of the first hydrostatic radial bearing B1 is increased. In contrast, the pressure P2 supplied to the second hydrostatic radial bearing B2 on the rear side of the ball polishing apparatus is held in a low pressure. The rotary shaft 8*a* is retained while the shaft support rigidity K of the second hydrostatic radial bearing B2 is reduced.

During the semi-finishing operation, the pressure supplied to the cylinders 22*a* is held at a low pressure so as to reduce the loads exerted on the balls. In this state, the pressure P1 supplied to the first hydrostatic radial bearing B is held at a low pressure, so that the shaft support rigidity K of the first hydrostatic radial bearing B1 is reduced. In contrast, the pressure P2 supplied to the second hydrostatic radial bearing B2 on the rear side of the ball polishing apparatus is held in a high pressure. The rotary shaft 8*a* is retained while the shaft support rigidity K of the second hydrostatic radial bearing B2 is increased.

The efficiency of machining of the balls is reduced to finely control the size and accuracy during the finishing operation, and therefore the pressure supplied to the cylinders 22*a* is held in a further lower pressure, thereby further reducing the loads exerted on the balls. In this state, the pressure P1 supplied to the first hydrostatic radial bearing Bi is held in a further lower pressure, so that the shaft support rigidity K of the first hydrostatic radial bearing B1 is reduced further. In contrast, the pressure P2 supplied to the second hydrostatic radial bearing B2 on the rear side of the ball polishing apparatus is held in a high pressure. The rotary shaft 8*a* is retained while the shaft support rigidity K of the second hydrostatic radial bearing B2 is increased.

As a result, the influence of the accuracy of rotation affecting the machining portions of the rotary plate 1 is reduced. If the rotary plate 1 is rotated along the axis of rotation defined by the annular grooves 4 formed in the plates 1 and 2 and by the balls sandwiched between the annular grooves 4, an abnormal force exerted on the balls is reduced, enabling superior finishing of the balls.

Is In the ball polishing apparatus of the fourth embodiment, the accuracy of polishing of the balls can be improved by, during the course of the polishing process, regulating the shaft support rigidity of the hydrostatic radial bearings B1 and B2 which are the bearing mechanism of the rotary plate 1, and particularly at the time of the finishing process bringing the annular grooves of the rotary plate 1 in alignment with the balls fitted in the annular grooves 4 of the fixed plate 2.

Fifth Embodiment

Figure 21:
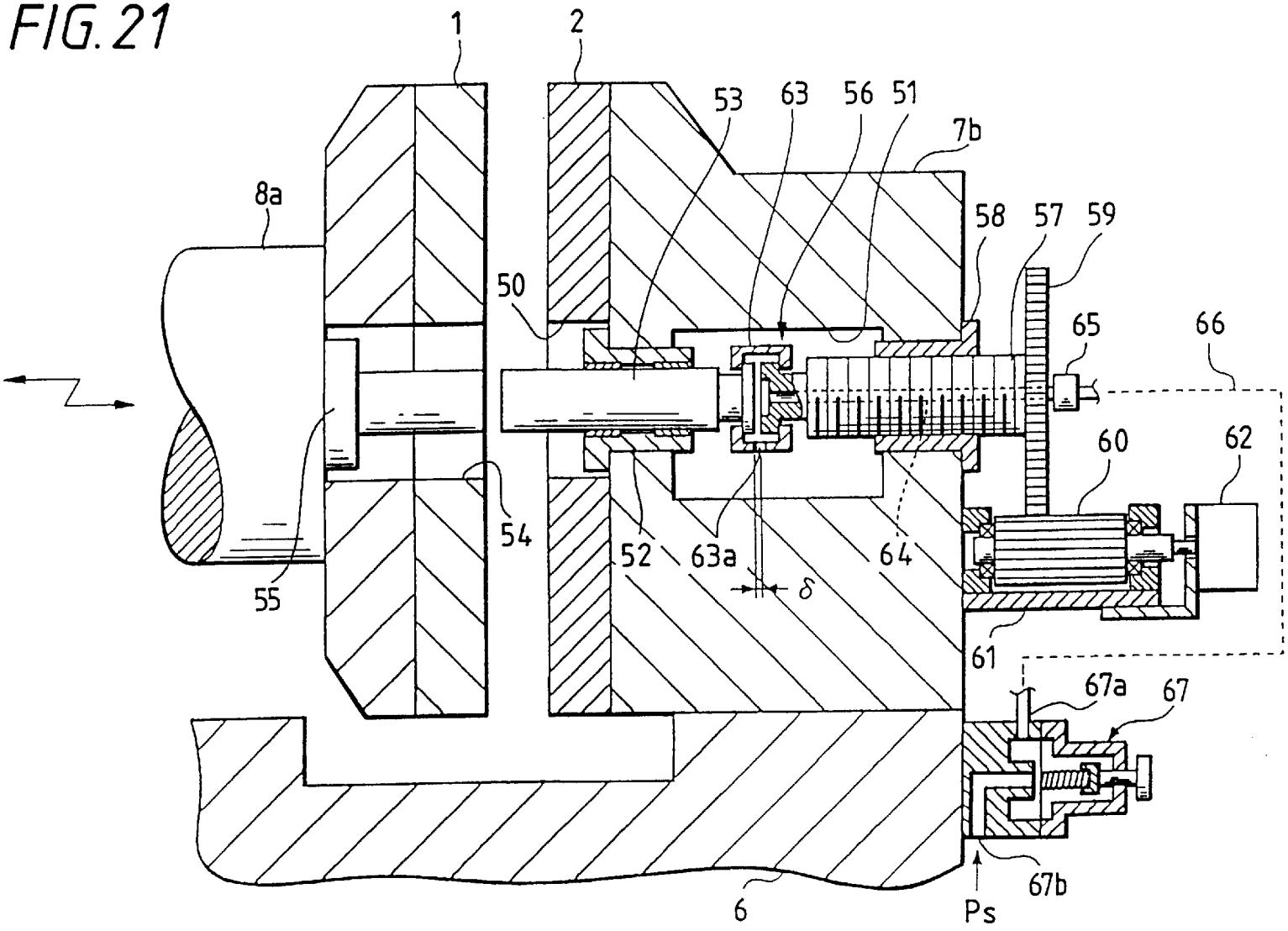
FIG. 21 is a schematic representation illustrating the structure of a ball polishing apparatus according to a fifth embodiment of the present invention.

Next, a fifth embodiment of the present invention will be described in reference to FIGS. 21 and 22. FIG. 21 is a longitudinal schematic side view illustrating the principal elements of a ball polishing apparatus according to a fifth embodiment of the present invention. In the drawings, the elements which are the same as those of the first embodiment illustrated in FIG. 7 will be assigned with the same reference numerals.

The present embodiment is directed to improve the accuracy of polishing of balls particularly at the time of the finishing process by bringing a stopper provided in the center of the fixed plate 2 into contact with the center of the end surface of the rotary plate 1 in order to limit a pressing force of the cylinder mechanism (the pressing mechanism) such that the machining pressure can be finely adjusted.

In FIG. 21, as in the case with the previous embodiments, the rotary plate 1 is rotatively supported by the first rotary shaft Ba, and the rotary plate 1 and the first rotary plate 8*a* are movable in the right and left directions (in the direction designated by arrow in the drawing) by means of the cylinder mechanism (the pressing mechanism). The fixed plate 2 is fixed to the other support member 7*b*, and through holes 50, 51 are formed so as to pass through the center of the support member 7*b*. A stopper 53 which forms a part of fine control means for finely adjusting the machining pressure is supported at one end of the through hole 51 of the support member 7*b* (in the left end portion of the through hole 51 in the drawing) via a bearing 52 so as to be movable in the direction of rotation and in the axial direction. The stopper 53 is formed into a rod shape having a predetermined axial length.

A through hole 54 is formed in the center of the rotary plate 1, and a rod receiving member 55 projects from the end of the first rotary shaft 8*a* within the through hole 54. The front end surfaces of the rod receiving member 55 and the stopper 53 are opposite to each other. The pressing force of the cylinder mechanism is limited by bringing the front end surface of the stopper 53 into contact with the front end surface of the rod receiving member 55 as required, thereby finely adjusting the machining pressure.

More specifically, the base end of the stopper 53 is connected to the front end of a screw shaft 57 via a hydrostatic bearing 56. The screw shaft 57 is formed from; e.g., a ball screw and is rotatively supported at the other end of the through hole 51 of the support member 7*b* via a nut 5B of the ball screw. A spur gear 59 is attached to the base end of the screw shaft 57 and meshes with a pinion gear 60. The pinion gear 60 is rotatively supported by a bracket 61 fixed to the end surface of the support member 7*b*. The pinion gear 60 is rotatively driven by a servo motor 62.

The movement (position) of the stopper 53 can be controlled in the right and left directions in the drawing by way of the pinion gear 60, the spur gear 59, the screw shaft 57, and the hydrostatic bearing 56 by forwardly or rearwardly rotating the servo motor 62.

The hydrostatic bearing 56 is provided with a coupling member 63 which establishes a connection so that the stopper 53 and the screw shaft 57 can rotate independently of each other. A working fluid (oil) outflow port 63*a* is formed in the coupling member 63.

The working fluid (oil) can be supplied into the hydrostatic bearing 56 by a pump (not shown). In short, a working fluid supply channel 64 is formed in the center of the screw shaft 57 over its entire length, and one end of the working fluid supply channel 64 is open in the coupling member 63. The other end of the working fluid supply channel 64 is connected to an outflow port 67*a* of a diaphragm control restrictor 67 having a known structure via a rotary coupling 65 and a hose 66. An inlet port 67*b* of the diaphragm control restrictor 67 is connected the delivery port of the pump, and an inlet port of the pump is connected to the non-illustrated working fluid tank. The diaphragm control restrictor 67 is fixed to the end face of the bed 6. Here, it is desirable that the diaphragm control restrictor 67 be fixed in a readily controllable position.

The working fluid (oil) stored in the working fluid tank is supplied to the inlet port of the diaphragm control restrictor 67 by the pump. The pressure of the working fluid is automatically restricted such that a clearance 6 between the end faces of the stopper 53 and the screw shaft 57 is held constant by the diaphragm control restrictor 67. The working fluid is supplied to the coupling member 63 of the hydrostatic bearing 56 by way of the hose 66, the rotary coupling 65, and the working fluid supply channel 64 in order. The working fluid supplied to the inside of the coupling member 63 is collected from the working fluid outflow port 63*a* of the coupling member 63 by the working fluid tank via the non-illustrated working fluid collecting circuit.

Next, the operation of the ball polishing apparatus of the fifth embodiment having the foregoing structure will be described. The ball polishing operation of the fifth embodiment is the same as that of each of the previous embodiments. However, the fifth embodiment is particularly characterized by fine adjustment of the machining pressure which is realized by bringing the front end surface of the stopper 53 into contact with the front end surface of the rod receiving member 55 so as to restrict the pressing force of the cylinder mechanism (the pressing mechanism) used for axially moving the rotary disk 1.

More specifically, the servo motor 62 is rotated in one direction, so that the stopper 53 is moved in the leftward direction in the drawing via the pinion gear 60, the spur gear 59, the screw shaft 57, and the hydrostatic bearing 56. As a result, the front end surface of the stopper 53 is brought into contact with the front end surface of the rod receiving member 55, whereby an axial thrusting force exerted on the rod receiving member 55 is received by the stopper 53. Consequently, a portion of the pressing force of the cylinder mechanism is received by the stopper 53, whereby the machining pressure is finely adjusted.

When the front end surface of the stopper 53 is brought into contact with the front end surface of the rod receiving member 55, the stopper 53 is rotated by the rod receiving member 5S. However, the stopper 53 is supported by the hydrostatic bearing 56, and hence the load exerted on the stopper 53 in the thrusting direction does not change substantially as a result of rotation.

The point in time when the front end surface of the stopper 53 is brought into contact with the front end surface of the rod receiving member 55 is a point in time when the size of the balls become close to a desired size. Further, the load exerted on the servo motor 62 of the stopper 53 or the load exerted on the front end surface of the screw shaft 57 is detected by a load detector such as a load cell. The position of the stopper 53 is controlled and retained so as to satisfy Equation (1) provided below by controlling the servo motor 62 on the basis of the thus-detected load.

$$fp=f0\times k(0<K\leqq 1) \quad (1)$$

Figure 22:
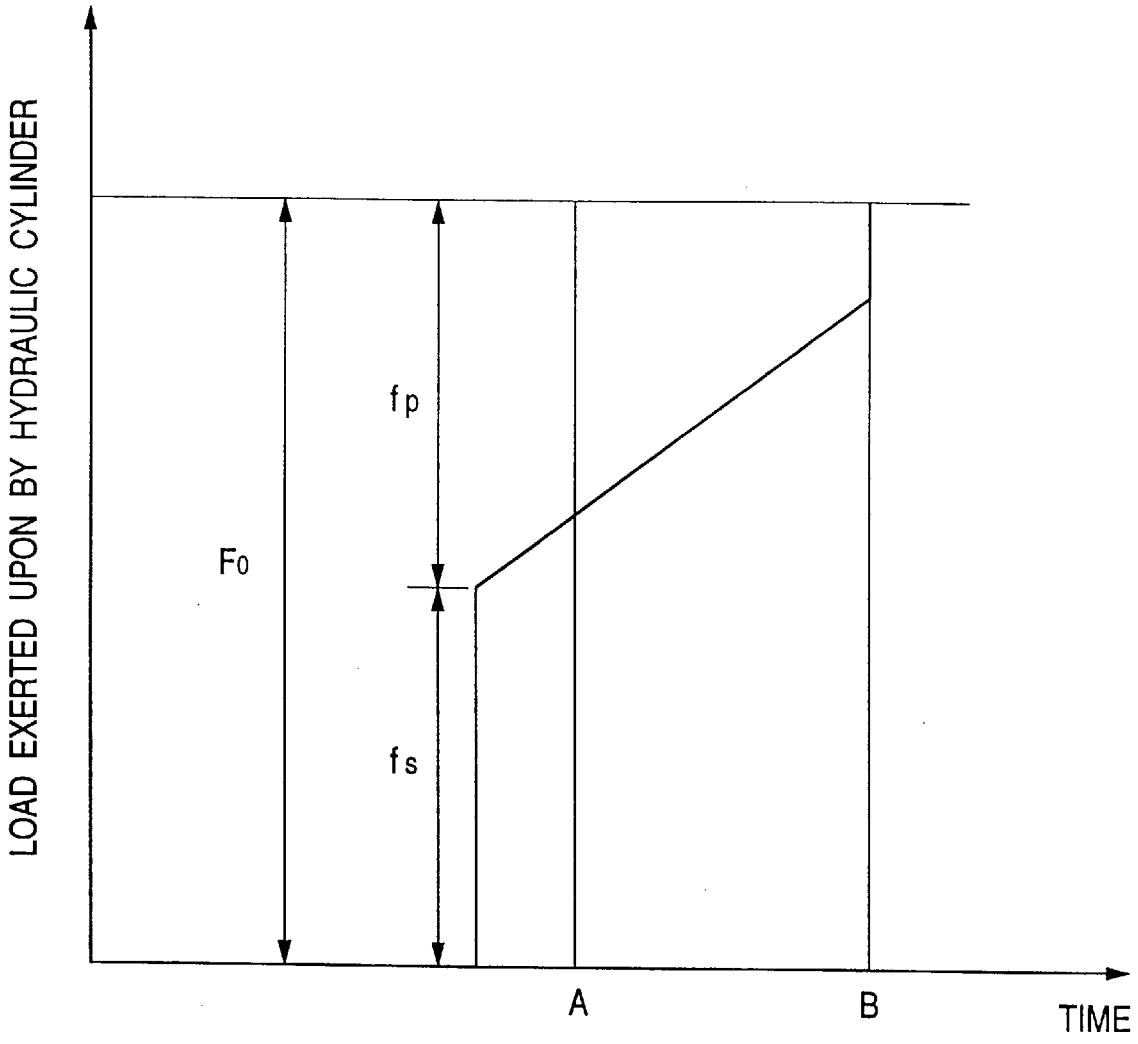
FIG. 22 is a plot illustrating the relationship between a machining pressure and time in a finishing process with regard to the ball polishing apparatus illustrated in FIG. 21.

FIG. 22 is a plot showing a machining pressure applied by the ball polishing apparatus of the fifth embodiment at the time of a finishing operation. In the drawing, the longitudinal axis of the plot represents a load applied by the cylinder mechanism for axially moving the rotary plate 1, and the horizontal axis represents time. F0 designates a force applied to the rotary plate 1 by the cylinder mechanism at the time of the finishing operation; i.e., the machining pressure on the initial stage of the finishing operation. Reference symbol fp designates a real machining pressure required when the stopper 53 is in an active state; i.e., when the front end surface of the stopper 53 is brought into contact with the front end surface of the rod receiving member 55. Reference symbol fs designates a stopping force of the stopper 53.

In FIG. 22, the force F0 applied by the cylinder mechanism corresponds to the machining pressure used in the conventional finishing process, and the machining operation is terminated at a point in time B. Point in time A designates a point in time when the stopper 53 is actuated; i.e., when the front end surface of the stopper 53 is brought into contact with the front end surface of the rod receiving member 55. As illustrated in FIG. 22, the machining pressure acting on the balls is F0 at the beginning. However, the machining pressure is reduced to fp at the point in time when the stopper 53 is actuated; i.e., at the point in time A The machining pressure gradually decreases from the point in time A as the polishing operation proceeds and as the difference between the balls decreases.

Because of the function of the stopper 53, in a case where a small number of balls (steel balls) having a slightly larger diameter than a certain diameter mixedly exist in a plurality of balls (steel balls) having the certain diameter between the plates 1 and 2 during the polishing process, a larger machining pressure acts on the balls having a slightly larger diameter, whereby they can be polished greatly. In contrast, the balls having the certain diameter undergo a smaller machining pressure, and hence the amount of polishing of the balls becomes small. Through repetition of these machining operations, the diametrical difference among the balls can be effectively reduced, thereby resulting in a state similar to a so-called spark-out state employed in a grinding operation.

Sixth Embodiment

Figure 23:
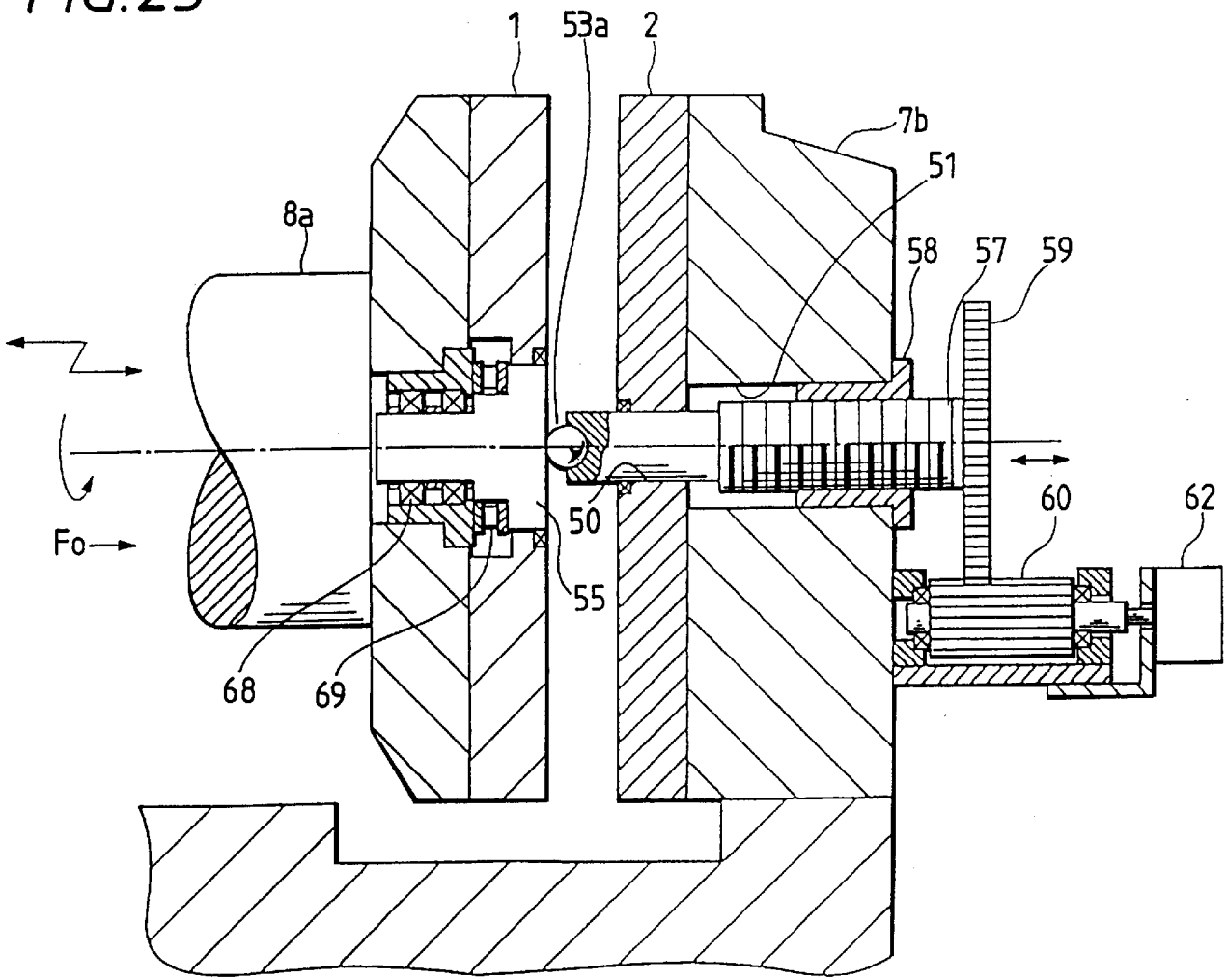
FIG. 23 is a longitudinal cross section illustrating the structure of a ball polishing apparatus according to a sixth embodiment of the present invention.

Next, a sixth embodiment of the present invention will be described in reference to FIG. 23. FIG. 23 is a longitudinal schematic side view of the principal elements of a ball polishing apparatus according to a sixth embodiment of the present invention. In the drawings, the elements which are the same as those of the fifth embodiment illustrated in FIG. 21 will be assigned with the same reference numerals.

FIG. 23 is different from FIG. 21 in that the bearing 52, the hydrostatic bearing 56, the rotary coupling 65, the hose 66, and the control restrictor 67 are omitted from the ball polishing apparatus illustrated in FIG. 21; that a steel stopper 53*a* is attached to the front end of the screw shaft 57 by blazing; and that the receiving member 55 is rotatively supported at the center of the rotary plate 1 via a radial bearing 68 and a thrust bearing 69. The thrust bearing 69 is a cylindrical thrust bearing having a cylindrical rolling element. The accuracy of size of the rolling element is rigorously selected in order to reduce deflections of a contact between the receiving member 55 and the stopper 53*a* in the right and left directions in the drawing to as small deflections as possible in a case where the receiving member 55 rotates with reference to the rotary plate 1.

The movement of the stopper 53*a* of the sixth embodiment and the operation and advantageous effects resulting from that movement are the same as those of the fifth embodiment, and therefore their detailed explanations will be omitted here.

Seventh Embodiment

A seventh embodiment of the present invention will be described with reference to FIG. 24. The seventh embodiment is directed to enable a reduction in the "plate conditioning time" required for the ball polishing process by contrivance of a method of forming annular grooves in a fixed plate which reduces an eccentricity between the center of annular grooves previously formed in the fixed plate and the center of rotation of a rotary plate to as small an extent as possible.

Figure 24:
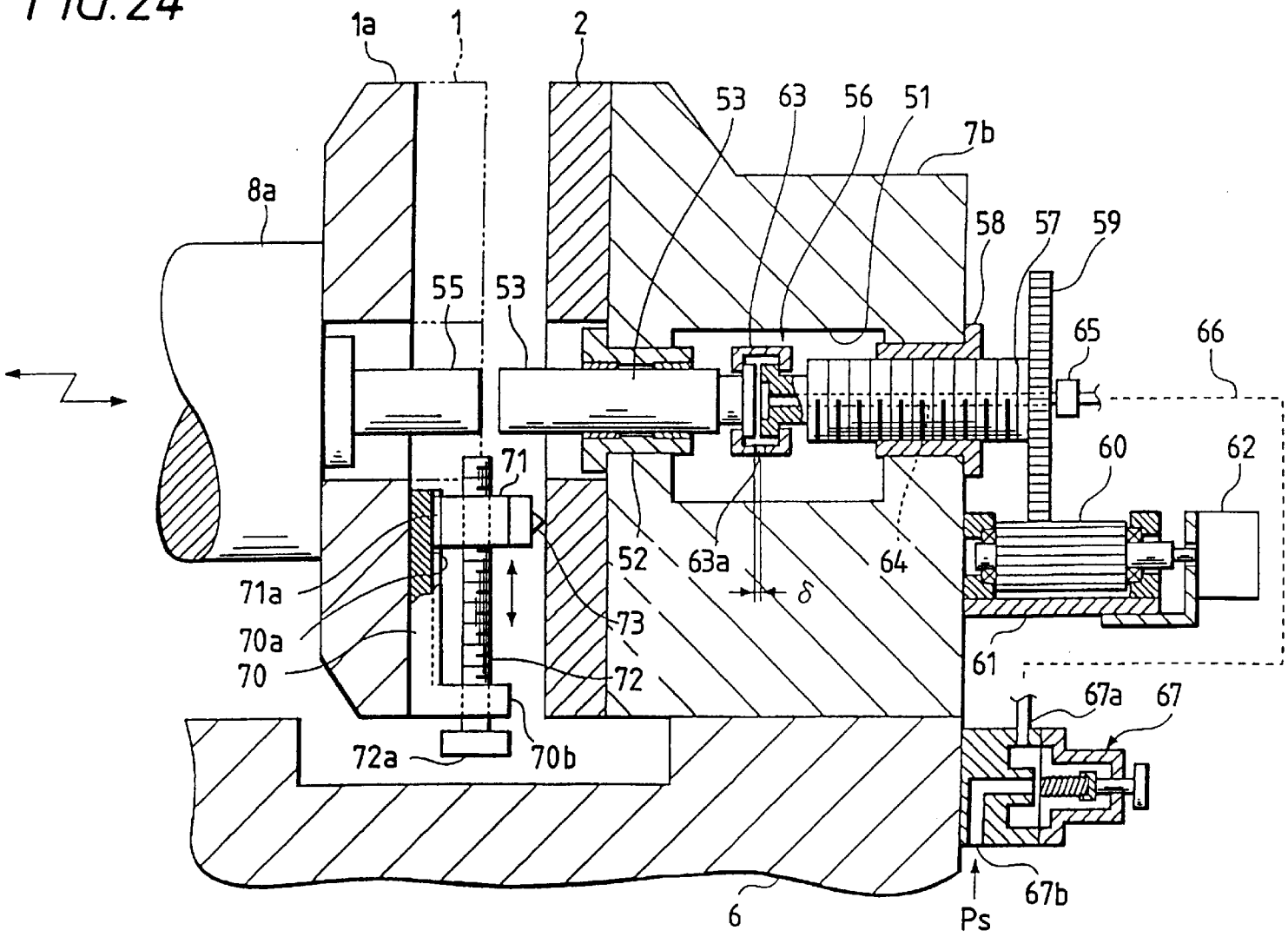
FIG. 24 is a schematic representation illustrating an annular groove forming method for use with a ball polishing apparatus according to a seventh embodiment of the present invention.

FIG. 24 is a schematic side view of a ball polishing apparatus according to a seventh embodiment of the present invention to describe a method of forming annular grooves in a fixed plate of the seventh embodiment. In FIG. 24, the elements which are the same as those of the fifth embodiment illustrated in FIG. 21 will be assigned with the same reference numerals.

As illustrated in FIG. 24, a rotary base plate la which is a rotary plate mount of the main body of the ball polishing apparatus rotates coaxially with the rotary plate 1. After the rotary plate 1 has been removed from the rotary base plate la, a tool rest mount base 70 is removably attached to the surface of the rotary base plate la opposite the fixed plate 2 through use of non-illustrated bolts. A tool rest 71 is attached to the tool rest mount base 70 so as to be movable in the direction orthogonal to the rotary axis of the rotary base plate la (i.e., in the direction designated by the arrow in the drawing). An engagement projection 71*a* protruding from one side surface of the tool rest 71 is engaged with an engagement groove 70*a* of the tool rest mount base 70 in a slidable manner.

A screw rod 72 consisting of a ball screw or the like is screwed into the center of the tool rest 71 and is supported by a support wall 70*b* of the tool rest mount base 70 so as to be rotatable and to be nonmovably in the axial direction. A control knob 72*a* is attached to the base end of the screw rod 72 (i.e., the lowermost end in the drawing). The position of the tool rest 71 can be adjusted by forwardly or rearwardly rotating the screw rod 72 with the control knob 72*a* so as to move the tool rest 71 in the direction designated by the arrow in the drawing. After the adjustment, the tool rest 71 can be fixed at the thus-adjusted position. A bite (cutter) 73 for cutting annular grooves is attached to the tool rest 71. The depth of the annular grooves formed in the fixed plate is determined by bringing the stopper 53 whose position is adjusted by the servo motor 62 into contact with the receiving member 55 attached to the rotary base plate la.

In reference to FIG. 24, procedures for creating the annular grooves 4 in the fixed plate 2 will be described. While the rotary base plate la is spaced apart from the fixed plate 2, the tool rest 71 is attached to the surface of the rotary base plate la opposite the fixed plate 2 via the tool rest mount base 70, as illustrated in FIG. 24. Then, the bite 73 is fitted to the tool rest 71. The screw rod 72 is forwardly or rearwardly rotated with the control knob 72*a* so as to move the tool rest 71 in the direction designated by the arrow in the drawing, so that the tip of the bite 73 is regulated and fixed at an initial position. The position of the tip of the bite 73 may be marked before the fixed plate 2 is attached to the support member 7*b* that is the fixed plate mount of the main body of the ball polishing apparatus.

Alternatively, the tip position may be measured by a scale or the like after the fixed plate 2 has been mounted on the support member 7*b*.

Next, the position of the stopper 53 is controlled by the servo motor 62 in consideration of a preset relative correlation between the position of the tip of the bite 73 attached to the rotary base plate la and the position of the front end of the receiving member 55, as well as of the depth of the annular grooves to be formed.

The rotary base plate 1*a* is rotatively driven by the rotary mechanism and is moved toward the fixed plate 2 by the guide slide mechanism. AB a result, the bite 73 is also moved close to the fixed plate 2, thereby cutting one annular groove in the fixed plate 2. The cutting of the annular groove is terminated when the stopper 53 comes into contact with the receiving member 55.

In this way, after the cutting of one annular groove has been completed, the tool rest 71 is moved on predetermined pitches in a radial direction of the rotary base plate la while measuring the pitches through use of a non-illustrated dial gage or the like. After the position of the tip of the bite 73 has been adjusted and fixed, the cutting operation which is same as the previously described cutting operation is repeated.

As has been described in detail, according to the method of forming annular grooves in a fixed plate of the seventh embodiment, annular grooves are cut in the fixed plate 2 while the bite is coaxially held in alignment with the axis of rotation of the rotary plate 1. Therefore, it is possible to form annular grooves without causing an eccentricity relative to the center of rotation of the rotary plate 1.

In the seventh embodiment, it is desirable to attach a balance weight to the rotary base plate la in order to ensure a balance against the annular groove cutting tools (the tool rest mount base 70, the tool rest 71, the screw rod 72, and the bite 73) attached to the rotary base plate la.

As has been described in detail, in one aspect of the ball polishing method and apparatus of the present invention, at least one of the rotary support means for supporting the rotary mechanism to rotate the plate and the guide support means for supporting the guide slide mechanism to guide the plate in a slidable manner, is hydrostatic. Therefore, a machining pressure can be controlled with a high degree of accuracy, and the accuracy of polishing of balls can be improved.

In another aspect of the ball polishing method and apparatus of the present invention, the rotary support means is formed into an rolling bearing, and the guide support means is formed into a hydrostatic guide. Therefore, the machining pressure can be controlled with a high degree of accuracy, and the accuracy of polishing of balls can be improved.

In still another aspect of the ball polishing method and apparatus of the present invention, the rotary support means is formed into a hydrostatic bearing, and the guide support means is formed into a rolling guide. Therefore, the machining pressure can be controlled with a high degree of accuracy, and the accuracy of polishing of balls can be improved.

In yet another aspect of the ball polishing method and apparatus of the present invention, the rotary support means is formed into a hydrostatic bearing, and the guide support means is formed into a hydrostatic guide. Therefore, the machining pressure can be controlled with a high degree of accuracy, and the accuracy of polishing of balls can be improved.

In a further aspect of the ball polishing method and apparatus of the present invention, the shaft support rigidity of the rotary support means is controlled by a rigidity regulation means. Therefore, errors in the rotation of the rotary plate can be reduced, and high-quality balls can be obtained.

In a still further aspect of the polishing method and apparatus of the present invention, the force acting on the faces of two plates which are opposite to each other as a result of pressing action of the press mechanism is finely adjusted by the fine adjustment means. While the force acting on the ball support portions of both plates is held constant, the balls can be polished without changing the aligned relationship between the rotary plate and the fixed plate.

Further, the force exerted on the balls between the plates can be controlled with a high degree of accuracy. Still further, the capability of correction of diametrical errors in the balls is improved, enabling manufacture of high-quality balls.

In another aspect of the method of forming annular grooves in a fixed plate for use with the ball polishing apparatus, the annular grooves can be formed in the fixed plate while the bite is held in a coaxial relationship with the axis of rotation of the rotary plate. As a result, the annular grooves can be formed in the fixed plate without causing an eccentricity relative to the center of rotation of the rotary plate. Moreover, the "plate conditioning time" can be reduced.

The foregoing description of the preferred embodiments of the invention has been presented for purposes of illustration and description. It is not intended to be exhaustive or to limit the invention to the precise form described. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A ball polishing method comprising the steps of:

rotating one of two plates through use of a rotating mechanism while balls are sandwiched between said two plates;

pressing one of said two plates against the other plate of said two plates via a guide slide mechanism for guiding one of said two plates to the other of said two plates by a pressing mechanism which applies a pressing force;

polishing said balls while the pressing force is regulated through use of a pressing force control mechanism; and hydrostatically supporting at least one of said rotating mechanism and said guide slide mechanism, wherein said guide slide mechanism is separately provided with said rotating mechanism, and said rotating mechanism is rotatable supported in an axial direction of said rotating mechanism by said guide slide mechanism through one of a hydrostatic guide and a rolling guide at a position radially outside of said rotating mechanism.

2. The ball polishing method as defined in claim 1, wherein said hydrostatically supporting step comprises the steps of:

rotatably supporting said rotating mechanism with a rolling bearing; and hydrostatically supporting said guide slide mechanism with a hydrostatic guide.

3. The ball polishing method as defined in claim 1, wherein said hydrostatically supporting step comprises the steps of:

hydrostatically and rotatably supporting said rotating mechanism with a hydrostatic bearing; and supporting said guide slide mechanism with a rolling guide.

4. The ball polishing method as defined in claim 1, wherein said hydrostatically supporting step comprises the steps of:

hydrostatically and rotatably supporting said rotating mechanism with a hydrostatic bearing; and hydrostatically supporting said guide slide mechanism with a hydrostatic guide.

5. The ball polishing method as defined in one of claims 1 through 4, further comprising the steps of:

finely controlling a force that is exerted on confronting faces of said two plates by the pressing force of the pressing mechanism.

6. The ball polishing method as defined in claim 1, wherein said rotating mechanism supports said one of two plates in the radial and thrust directions.

7. The ball polishing method as defined in one of claims 1, 3 and 6, further comprising the steps of:

suppressing positional variations between annular grooves formed in one of said two plates so as to face the other of said two plates and annular grooves formed in the other of said two plates so as to be confronted with the annular grooves of the one of said two plates, wherein said step of suppressing positional variations includes controlling said pressing force by said pressing force control mechanism and variably controlling a shaft supporting rigidity (K) for said one of two plates by a shaft rigidity controlling mechanism during a polishing operation.

8. The ball polishing method in accordance with claim 7, further comprising the steps of increasing the shaft supporting rigidity during a roughing machining step and reducing the shaft supporting rigidity during a finishing machining step using said shaft rigidity controlling mechanism.

9. The ball polishing method in accordance with claim 1, wherein said one of two plates which is rotated defines a rotary plate and said other plate defines a stationary plate, and further comprising the steps of:

providing a stopper in said stationary plate, said stopper being movable with respect to said stationary plate in an axial direction of said stationary plate;

providing a control mechanism for controlling a position of said stopper with respect to said stationary plate;

bringing said stopper into contact with said rotary plate during a machining operation using said control mechanism so as to limit the pressing force of said pressing mechanism acting on the balls.

10. A ball polishing apparatus comprising:

two plates, a rotating mechanism for rotating one of said two plates while balls are sandwiched between said two plates, a guide slide mechanism for guiding said one of said two plates to the other of said two plates, in which said guide slide mechanism is separately provided with said rotating mechanism and is disposed at a position radially outside of said rotating mechanism;

a pressing mechanism which applies a pressing force for pressing one of said two plates against the other of said two plates via said guide slide mechanism so as to polish the balls while the pressing force is regulated through use of a pressing force control mechanism;

rotary support means for supporting the rotating mechanism; and guide support means for supporting the guide slide mechanism, wherein at least one of said rotary support means and said guide support means utilizes hydrostatics.

11. The ball polishing apparatus as defined in claim 10, wherein said rotary support means is a rolling bearing, and said guide support means is a hydrostatic guide.

12. The ball polishing apparatus as defined in claim 10, wherein said rotary support means is a hydrostatic bearing, and said guide support means is a rolling guide.

13. The ball polishing apparatus as defined in claim 10, wherein said rotary support means is a hydrostatic bearing, and said guide support means is a hydrostatic guide.

14. The ball polishing apparatus as defined in one of claims 10 through 13 further comprising:

fine adjustment means for finely controlling the force that is exerted on the opposite faces of the two plates by the pressing force of the pressing mechanism.

15. The ball polishing apparatus as defined in claim 10, wherein said rotating mechanism supports said one of two plates in the radial and thrust directions.

16. The ball polishing apparatus as defined in one of claims 10, 12, 13, and 15 further comprising:

a rigidity control mechanism for controlling the shaft support rigidity of the rotary support means in order to suppress positional variations between annular grooves formed in one of the plates so as to face the other plate and annular grooves formed in the other plate so as to face the annular grooves of said one of the plates through use of a rigidity control mechanism.

17. The ball polishing apparatus in accordance with claim 16, wherein said rigidity control mechanism increases the shaft support rigidity during a roughing machining step and reduces the shaft supporting rigidity during a finishing machining step.

18. The ball polishing apparatus in accordance with claim 10, wherein said one of two plates which is rotated defines a rotary plate and said other plate defines a stationary plate, and further comprising:

a stopper in said stationary plate, said stopper being movable with respect to said stationary plate in an axial direction of said stationary plate;

a control mechanism for controlling a position of said stopper with respect to said stationary plate so as to limit the pressing force of said pressing mechanism acting on the balls.

* * * * *